US009089225B2

(12) United States Patent
Fiore, III et al.

(10) Patent No.: US 9,089,225 B2
(45) Date of Patent: Jul. 28, 2015

(54) CHILD HOLDING ACCESSORY FOR USE WITH A PLAY YARD

(75) Inventors: Joseph F. Fiore, III, Plano, TX (US); Andrew J. Taylor, Mohnton, PA (US); Sharon A. Gillett, Mohnton, PA (US); Andrew J. Horst, West Lawn, PA (US); Curtis M. Hartenstine, Birdsboro, PA (US); Nathanael Saint, Elverson, PA (US); Guang-Hui Zhao, Central Hong Kong (HK); Haibo Zeng, Central Hong Kong (HK); Wuxing Xu, Central Hong Kong (HK); Jonathan M. Pacella, Coatesville, PA (US)

(73) Assignee: Wonderland Nurserygoods Company Limited (HK)

( * ) Notice: Subject to any disclaimer, the term of this patent is extended or adjusted under 35 U.S.C. 154(b) by 428 days.

(21) Appl. No.: 13/206,589

(22) Filed: Aug. 10, 2011

(65) Prior Publication Data

US 2012/0037869 A1 Feb. 16, 2012

Related U.S. Application Data

(60) Provisional application No. 61/401,310, filed on Aug. 11, 2010, provisional application No. 61/455,901, filed on Oct. 28, 2010, provisional application No. 61/463,390, filed on Feb. 16, 2011.

(30) Foreign Application Priority Data

Jul. 6, 2011 (CN) ..... 2011 1 0188042

(51) Int. Cl.

| | |
|---|---|
| ***A47D 9/00*** | (2006.01) |
| ***A47D 5/00*** | (2006.01) |
| ***A47D 13/06*** | (2006.01) |

(52) U.S. Cl.
CPC *A47D 9/005* (2013.01); *A47D 5/00* (2013.01); *A47D 13/063* (2013.01)

(58) Field of Classification Search
CPC ..... A47D 9/005; A47D 13/063; A47D 5/00; A47D 5/006; A47D 7/00; A47D 7/007; A47D 7/01; A47D 9/00; A47D 13/00; A47D 13/06; A47D 13/061; A47D 15/00; A47D 15/008; A47B 23/02; A47B 23/025
USPC ..... 5/93.1, 93.2, 98.1, 99.1, 101, 102, 655, 5/503.1, 507.1, 658, 1, 3, 24, 621, 623, 5/624, 646, 648; 108/49; 256/25
See application file for complete search history.

(56) References Cited

U.S. PATENT DOCUMENTS

| | | | |
|---|---|---|---|
| 4,882,799 | A | 11/1989 | Shapiro |
| 5,369,826 | A | 12/1994 | Ikeda |

(Continued)

FOREIGN PATENT DOCUMENTS

| | | | |
|---|---|---|---|
| CN | 2209909 | Y | 10/1995 |
| CN | 1383775 | A | 12/2002 |
| CN | 101361627 | A | 8/2007 |
| CN | 201061386 | Y | 5/2008 |
| CN | 201664118 | U | 12/2010 |
| CN | 102631103 | A | 8/2012 |
| DE | 202008017117 | U1 | 5/2009 |
| WO | 8402260 | A1 | 6/1984 |

*Primary Examiner* — Nicholas Polito
(74) *Attorney, Agent, or Firm* — David I. Roche; Baker & McKenzie LLP

(57) ABSTRACT

A child holding accessory can be desirably installed on the play yard for use, and has two opposite regions adapted to receive a child in different configurations of use. Examples of construction for these holding regions can include, without limitation, a changing table and a child sleep bed. The child holding accessory can be attached with the play yard via one or more fixtures that is adjustable to turn upward either of the first and second regions for use.

39 Claims, 28 Drawing Sheets

(56) References Cited

U.S. PATENT DOCUMENTS

| | | | | |
|---|---|---|---|---|
| 6,173,462 | B1 | 1/2001 | Huang et al. | |
| 6,539,563 | B1 | 4/2003 | Hsia | |
| 2006/0080776 | A1 * | 4/2006 | Clapper et al. | 5/93.1 |
| 2006/0130237 | A1 | 6/2006 | Clapper et al. | |
| 2006/0225204 | A1 | 10/2006 | Bretschger et al. | |
| 2006/0225205 | A1 | 10/2006 | Troutman | |
| 2006/0253979 | A1 | 11/2006 | Chen | |
| 2008/0034506 | A1 | 2/2008 | Chen et al. | |
| 2009/0188039 | A1 * | 7/2009 | Shan et al. | 5/93.1 |
| 2010/0229301 | A1 | 9/2010 | Arnold, IV et al. | |
| 2012/0204347 | A1 | 8/2012 | Li | |

* cited by examiner

CHILD HOLDING ACCESSORY FOR USE WITH A PLAY YARD

CROSS-REFERENCE TO RELATED APPLICATION(S)

This application claims priority to U.S. Provisional Patent Application No. 61/401,310 filed Aug. 11, 2010; U.S. Provisional Patent Application No. 61/455,901 filed on Oct. 28, 2010; U.S. Provisional Patent Application No. 61/463,390 filed on Feb. 16, 2011; and Chinese Patent Application No. 201110188042.9 filed on Jul. 6, 2011.

BACKGROUND OF THE INVENTION

1. Field of the Invention

The present invention relates to child holding accessories suitable for use with play yards.

2. Description of the Related Art

Play yards are used to contain and provide a safe environment for a child to sleep or play. Currently, most play yards are constructed to include a frame around which a fabric element is wrapped and stretched to form the boundaries of the play yard. Due to the wide spread use of play yards, efforts have been made to increase their versatility to caregivers. For example, some child holding accessories may be added to play yards, such as changing tables (also commonly called "changers", bassinets, and child sleep beds (also commonly called "nappers"). While these different types of accessories may provide more versatility, it may be expensive to purchase a different accessory for each use. Moreover, it may also be cumbersome to store multiple child holding accessories, or change the accessory for each different use.

Therefore, there is a need for an improved child holding accessory that may be more convenient in use, and address at least the foregoing issues.

SUMMARY

The present application describes a child holding accessory that can be used in combination with a play yard. The child holding accessory can be desirably installed on the play yard for use, and integrate multiple regions adapted to receive a child in different configurations of use. Examples of construction for these holding regions can include, without limitation, a changing table and a child sleep bed. The child holding accessory can be attached with the play yard via one or more fixtures that is adjustable to turn upward either of the first and second regions for use.

At least one advantage of the structures described herein is the ability to provide a child holding accessory that has multiple regions adapted to receive a child for different configurations of use. Accordingly, the child holding accessory can be more versatile in use.

The foregoing is a summary and shall not be construed to limit the scope of the claims. The operations and structures disclosed herein may be implemented in a number of ways, and such changes and modifications may be made without departing from this invention and its broader aspects. Other aspects, inventive features, and advantages of the invention, as defined solely by the claims, are described in the non-limiting detailed description set forth below.

DETAILED DESCRIPTION OF THE EMBODIMENTS

The present application describes a child holding accessory that can be used in combination with a play yard. The child holding accessory can integrate multiple regions adapted to receive a child in different configurations of use. Examples of construction for these holding regions can include, without limitation, a changing table and a child sleep bed. The child holding accessory can be attached with the play yard via one or more fixtures adjustable to selectively turn upward either of the first and second regions for placement of the child.

Figure 1:
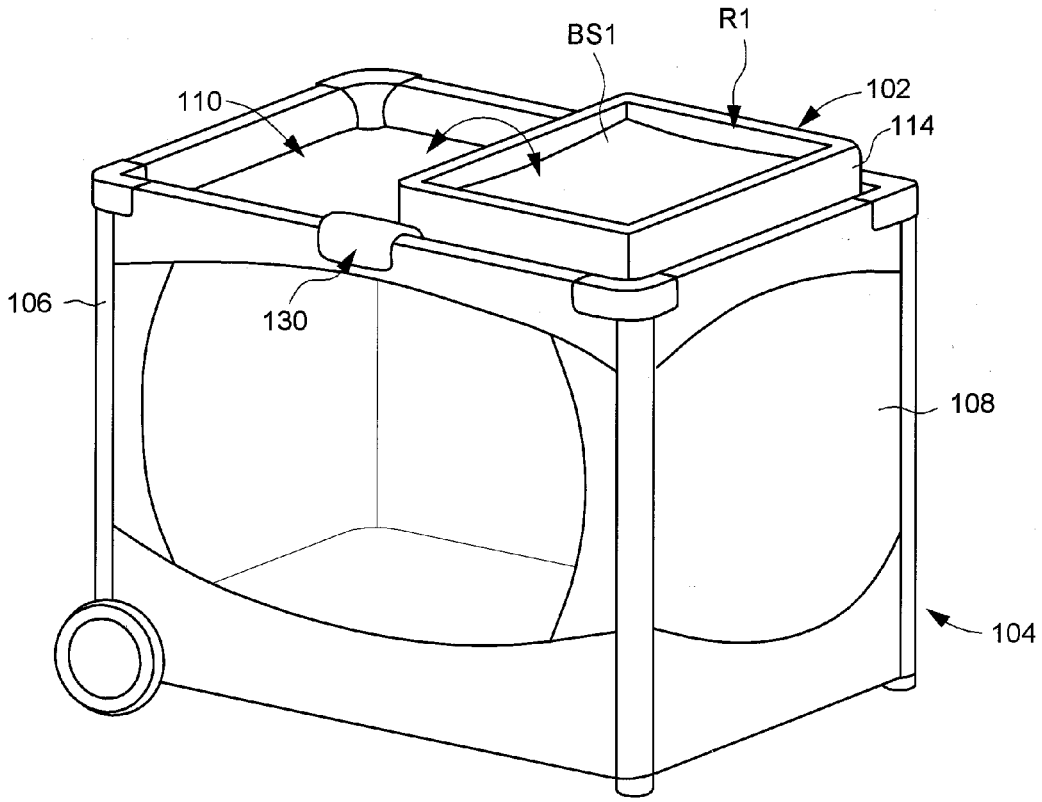
FIG. 1 is a schematic view illustrating a first embodiment of a child holding accessory provided in a first configuration of use on a play yard.
Figure 2:
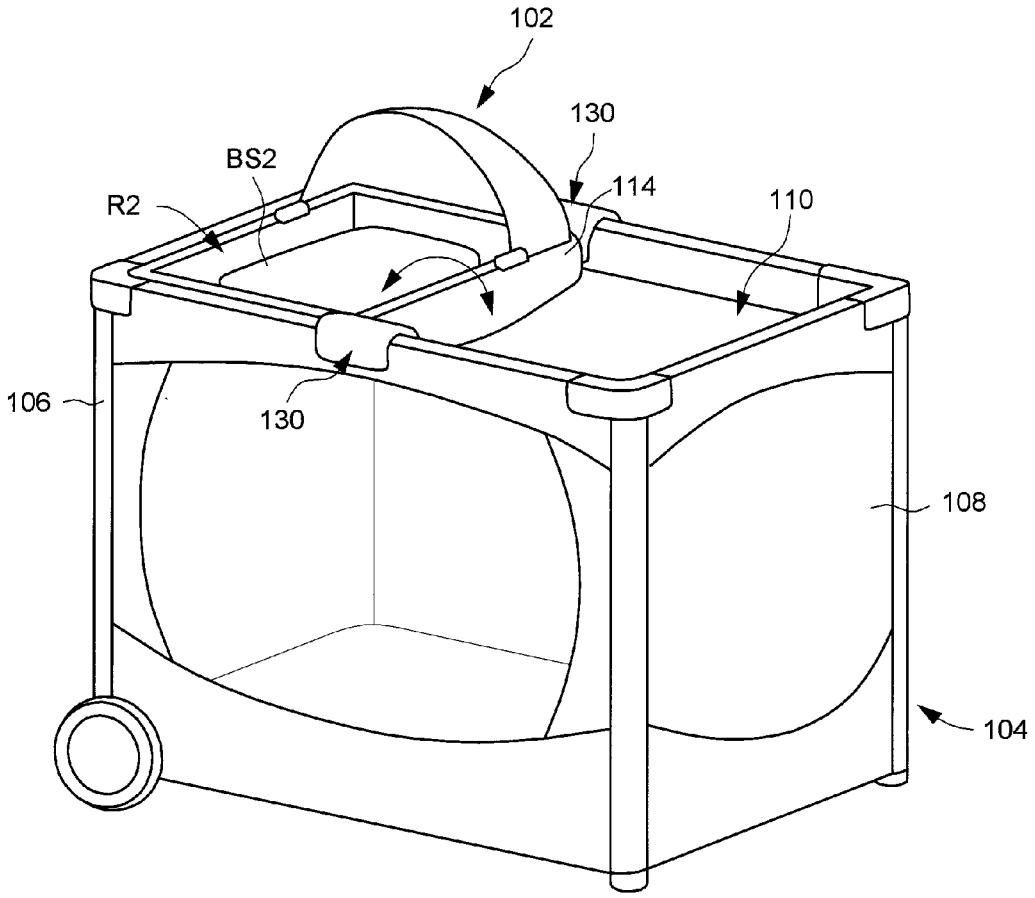
FIG. 2 is a schematic view illustrating the play yard in a second configuration of use.

FIGS. 1 and 2 are schematic views illustrating an embodiment of a child holding accessory 102 suitable for use with a play yard 104. The play yard 104 can include a rigid support frame 106 over which is held an enclosure 108 that defines an inner space 110 opened upward. In one embodiment, the enclosure 108 can be made of a flexible cloth material that is stretched around the support frame 106 to define multiple sidewalls surrounding the inner space 110. The child holding accessory 102 can be detachably mounted at an upper side of the enclosure 108 above the inner space 110. The child holding accessory 102 is thereby adapted to receive a child at an elevated position on the play yard 104, so that care of the child can be facilitated.

As shown in FIGS. 1 and 2, the child holding accessory 102 can be constructed as an adjustable module that includes a resting support 114 having multiple regions adapted to receive a child. Examples of these regions can include, without limitation, a first region R1 constructed as a changing table, and a second region R2 constructed as a child sleep bed on a side opposite to the side of the first region R1. For this purpose, each of the regions R1 and R2 can be constructed to have different flexible and/or recessed bearing surfaces BS1, BS2 on which the child can be placed. For example, the first region R1 can use a fabric that is water-proof and easy to wipe-off, like polyvinyl chloride (PVC)-based or ethylene vinyl acetate (EVA)-based polymer materials. The second region R2 can use soft and comfortable fabric, like cotton cloth or flannelette. The child holding accessory 102 can be adjustable to turn the second region R2 downward and the first region R1 upward to be used as a changing table (as shown in FIG. 1), or to reversely turn the first region R1 downward and the second region R2 upward to be used as a child sleep bed (as shown in FIG. 2). This adjustment of the child holding accessory 102 can be permitted by using one or more adjustable fixtures 130 to attach the resting support 114 with the play yard 104.

Figure 3:
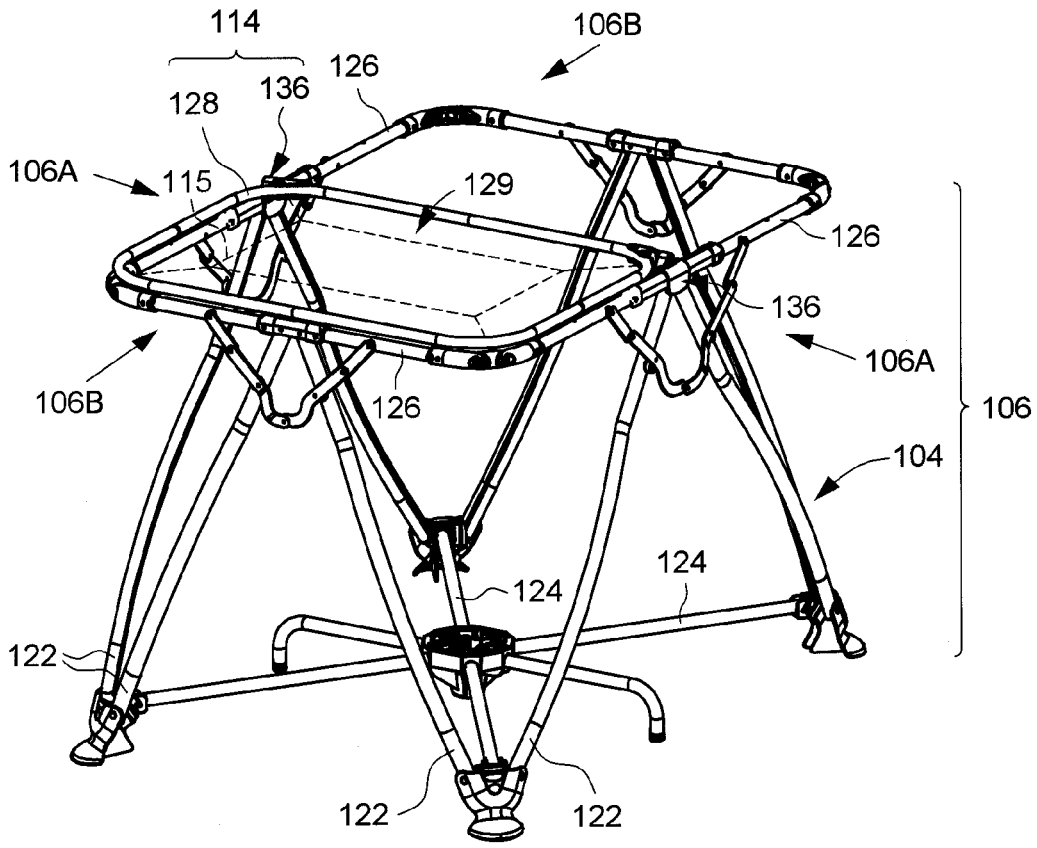
FIG. 3 is a schematic view illustrating how a resting support of the child holding accessory can be attached with the play yard.
Figure 4:
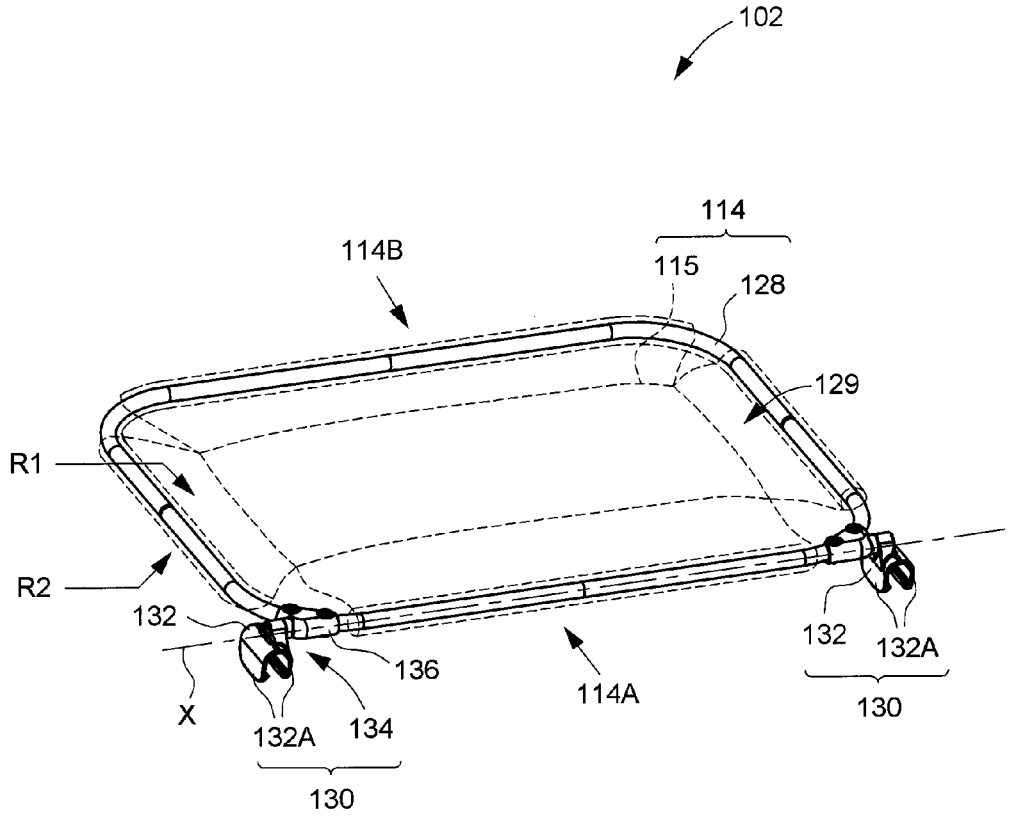
FIG. 4 is a schematic view showing the resting support shown in FIG. 3 alone.

FIG. 3 is a schematic view illustrating how the resting support 114 of the child holding accessory 102 may be attached with the play yard 104, and FIG. 4 is a schematic view showing the resting support 114 alone. The play yard 104 can include a support frame 106 formed from the assembly of multiple tubular segments that define a rectangular contour of the play yard 104. For example, the support frame 106 can comprise a plurality of legs 122 provided at corners of the play yard 104, lower diagonal segments 124 joined with lower regions of the legs 122, and upper handrails 126 joined with upper regions of the legs 122. The upper handrails 126 can define a rectangular contour including two opposite first sides 106A and two opposite second sides 106B of the play yard 104.

As shown in FIG. 4, the resting support 114 can include a surrounding frame 128 formed from multiple tubular segments connected together to define a central gap 129. Soft and/or flexible materials 115 (shown with phantom lines), for example webbing materials, cushion, foamed polymer and like materials capable of sustaining the weight of a child with comfort, can also be laid in the central gap 129 and fixedly secured with the surrounding frame 128 to define the regions R1 and R2.

The resting support 114 can be provided with fixtures 130 through which it can be attached with the upper handrails 126 of the support frame 106, for example at the two opposite sides 106A. In one embodiment, two fixtures 130 may be securely mounted with the surrounding frame 128 on a first side portion 114A of the resting support 114. The fixtures 130 may be placed at spaced apart positions adjacent to the corners of the first side portion 114A. Each of the fixtures 130 can include a clamp 132, and an adjustable coupling structure 134 that connects the resting support 114 with the clamp 132. The clamp 132 can have a C-shape including two resilient catch portions 132A adapted to clamp and unclamp a portion of the upper handrail 126 by elastic deformation. The adjustable coupling structure 134 can be constructed to pivotally connect the resting support 114 with the clamp 132.

Figure 5:
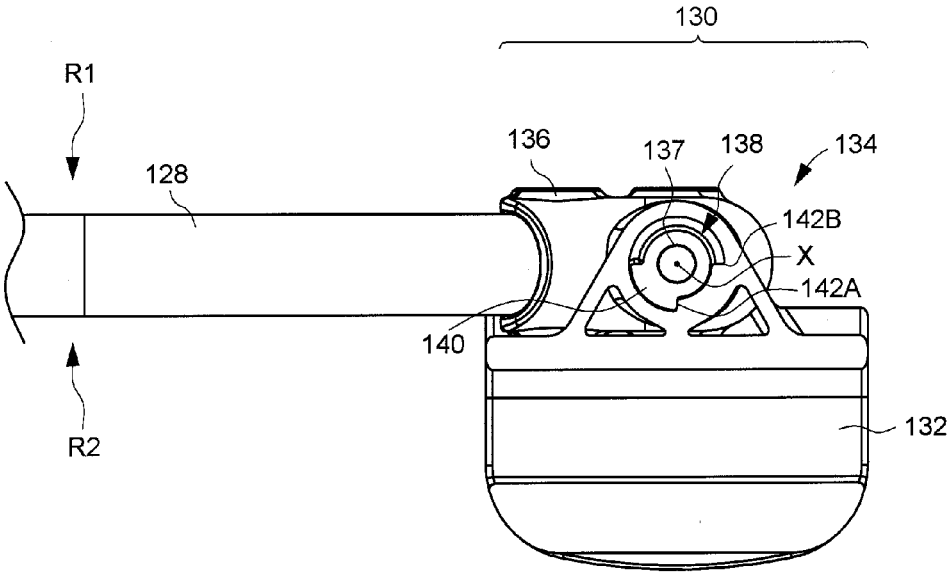
FIG. 5 is a partial cross-sectional view illustrating a fixture of the child holding accessory.

FIG. 5 is a partial cross-sectional view illustrating the fixture 130 in more details. The adjustable coupling structure 134 can include a coupling bracket 136 that is affixed with the surrounding frame 128 of the resting support 114. The coupling bracket 136 can include a shaft 137 that is pivotally assembled through a hole 138 provided in a raised portion of the clamp 132 to define a pivot axis X of the child holding accessory 102. The shaft 137 can include a radial rib 140 that can come into contact against either of two opposite stop abutments 142A and 142B provided on the inner surface of the hole 138 as the resting support 114 pivots in either direction. The stop abutments 142A and 142B can define the range of rotation for adjusting the resting support 114. For example, the contact between the radial rib 140 and the stop abutment 142A can arrest the resting support 114 in a first position where the first region R1 is turned upward for use, whereas the second region R2 of the resting support 114 is turned downward. In contrast, when the resting support 114 is rotated about the pivot axis X in a reverse direction to have the radial rib 140 contact with the stop abutment 142B, the resting support 114 can be adjusted to a second position where the first and second regions R1 and R2 are reversely oriented (i.e., the second region R2 is turned upward for use, whereas the first region R1 is turned downward).

Figure 6:
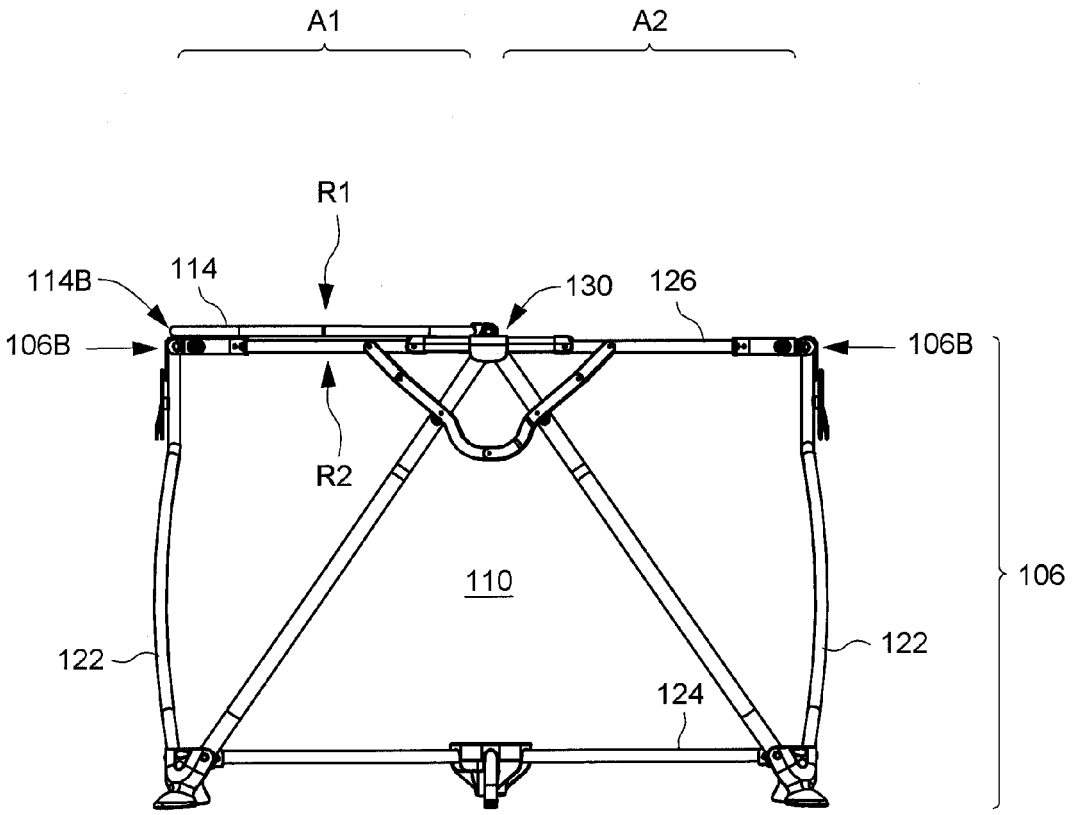
FIGS. 6 through 8 are schematic views illustrating an exemplary operation for adjusting the child holding accessory relative to the play yard.
Figure 7:
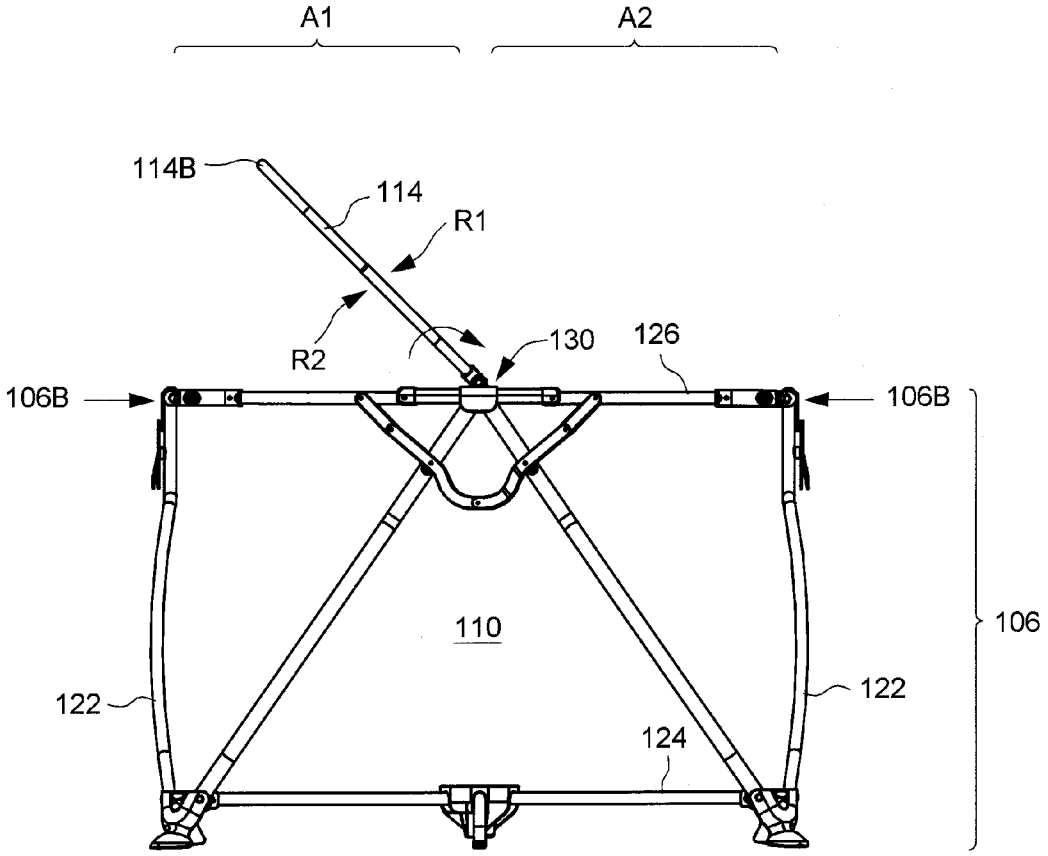
Figure 8:
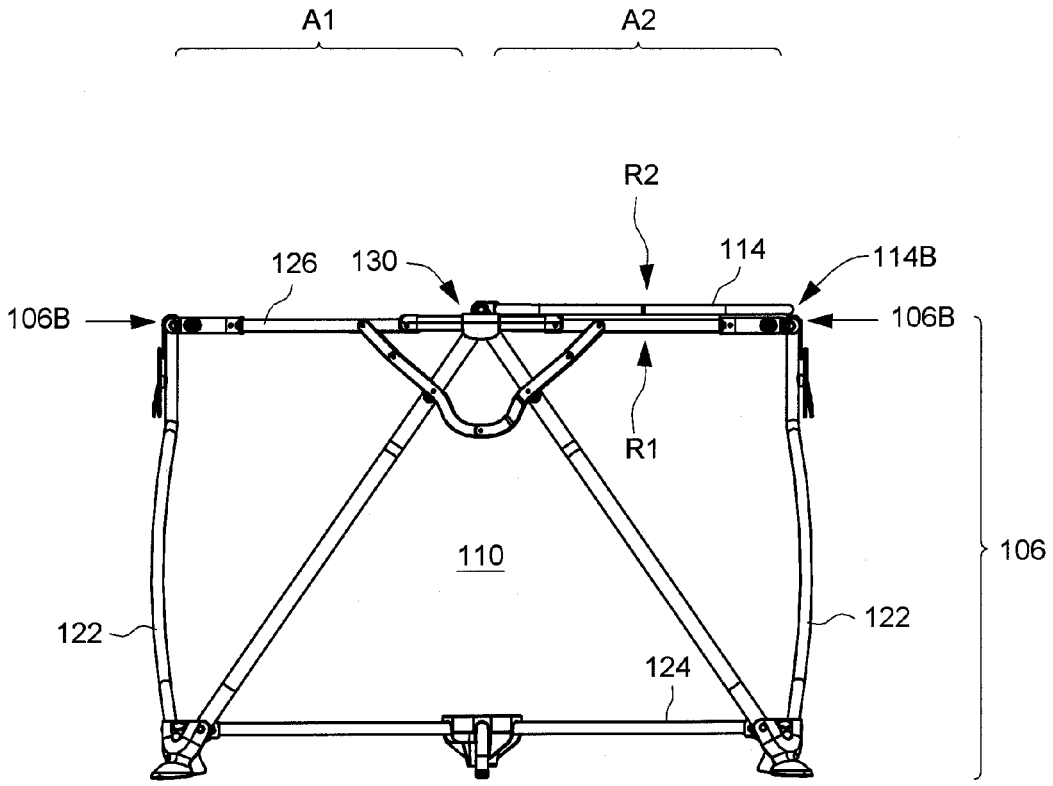
Figure 9:
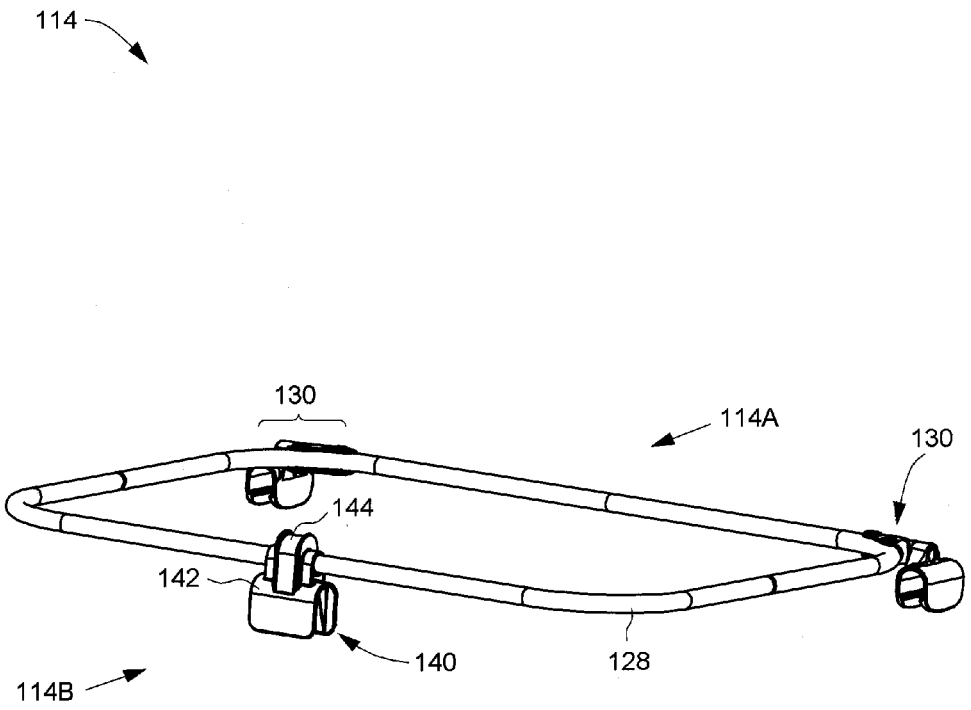
FIG. 9 is a schematic view illustrating a variant embodiment of the child holding accessory shown in FIG. 1 provided with an additional fixture.
Figure 10:
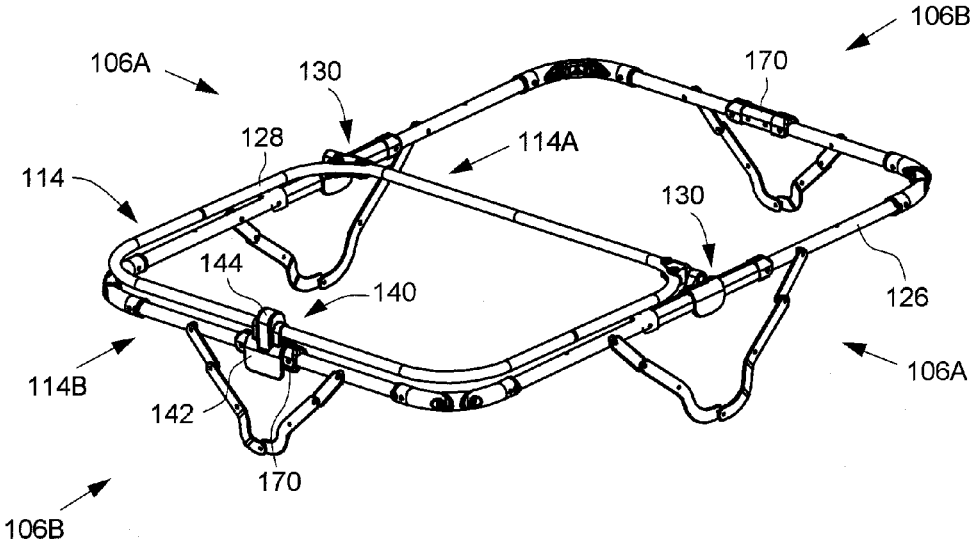
FIG. 10 is a schematic view illustrating the child holding accessory shown in FIG. 9 attached with the upper handrails of the support frame of the play yard.

Exemplary operation for adjusting the child holding accessory relative to the play yard is described hereafter with reference to FIGS. 6 through 8. For clarity, the play yard can be represented by the support frame 106 and the child holding accessory by the resting support 114 (in particular, the surrounding frame 128 thereof). In FIG. 6, the resting support 114 is attached with the upper handrails 126 of the support frame 106 at a first position lying approximately horizontal over a first area A1 of the play yard inner space 110. The fixtures 130 can be attached with two opposite upper handrails 126 at the first sides 106A of the support frame 106 (as better shown in FIG. 3). The fixtures 130 can be positioned adjacent to a middle area of the opposite first sides 106A. A second side portion 114B of the resting support 114 can be supported by the upper handrail 126 at one of the two second sides 106B. In this first configuration of use, the first region R1 of the resting support 114 can be turned upward to be used as a changing table, while the second region R2 is turned downward.

In case the child holding accessory is to be used as a sleep bed, the resting support 114 can be flipped by rotation about the pivot axis X until the resting support 114 reaches a second position lying approximately horizontal over a second area A2 of the play yard inner space 110 contiguous to the first area A1, as shown in FIGS. 7 and 8. In this second configuration of use, the second side portion 114B of the resting support 114 can be supported by the upper handrail 126 at the other second side 106B of the support frame 106. Moreover, the second region R2 of the resting support 114 can be turned upward to be used as a sleep bed, while the first region R1 is turned downward.

In the aforementioned embodiment, the fixtures 130 embody two attachments to secure the child holding accessory with the play yard. However, additional attachment may also provided, as illustrated in FIGS. 9-12.

FIGS. 9 through 12 are schematic views showing a variant embodiment of the resting support 114 with an additional fixture 140. Like previously described, the resting support 114 can be provided with the fixtures 130 to attach a child holding accessory with a play yard. The additional fixture 140 can be pivotally assembled with the surrounding frame 128 at the second side portion 114B of the resting support 114 opposite to the side where the fixtures 130 are installed. As better shown in the cross-sectional view of FIG. 12, the fixture 140 can include a clamp 142, a release button 144 and a spring 146. The clamp 142 can be constructed to include a collar portion 148, and two resilient catch portions 150 joined with one side of the collar portion 148. The collar portion 148 can be pivotally mounted around a portion of the surrounding frame 128. An inner sidewall of each catch portion 150 can include a protruding flange 152 and an angled surface 154. The clamp 142 also includes two openings 156 formed through an upper region of the catch portions 150 for mounting the release button 144.

The release button 144 can have a generally U-shape including two side push portions 158, and a junction 160 connected with the push portions 158. The release button 144 is mounted over the collar portion 148 in a saddling way with the push portions 158 movably passing through the openings 156 so as to lie adjacent to the inner sidewalls of the catch portions 150. The spring 146 can be mounted in an inner gap defined between the collar portion 148 of the clamp 142 and the junction 160 of the release button 144, and is respectively anchored with protrusions 162 and 164 formed on the collar portion 148 and inner surface of the junction 160. The inner sidewalls of the push portions 158 can also include stop abutments 166 provided adjacent to a side of the collar portion 148 opposite to the side of the spring 146. The stop abutments 166 can contact with the collar portion 148 to limit the extension of the spring 146 and define the initial position of the release button 144.

Depending on the orientation of the resting support 114, the fixture 140 can be pivoted relative to the resting support 114 so as to adequately orient the catch portions 150 for clamping the adjacent upper handrail 126. For example, when the first region R1 is oriented upward, the fixture 140 can be turned to orient the catch portions 150 in a direction opposite to the first region R1 so that it can engage with the corresponding side 106B of the support frame 106. Should the fixture 140 be reversely adjusted to have the second region R2 turned upward, the fixture 140 can be turned to orient the catch portions 150 in a direction opposite to the second region R2.

Figure 11:
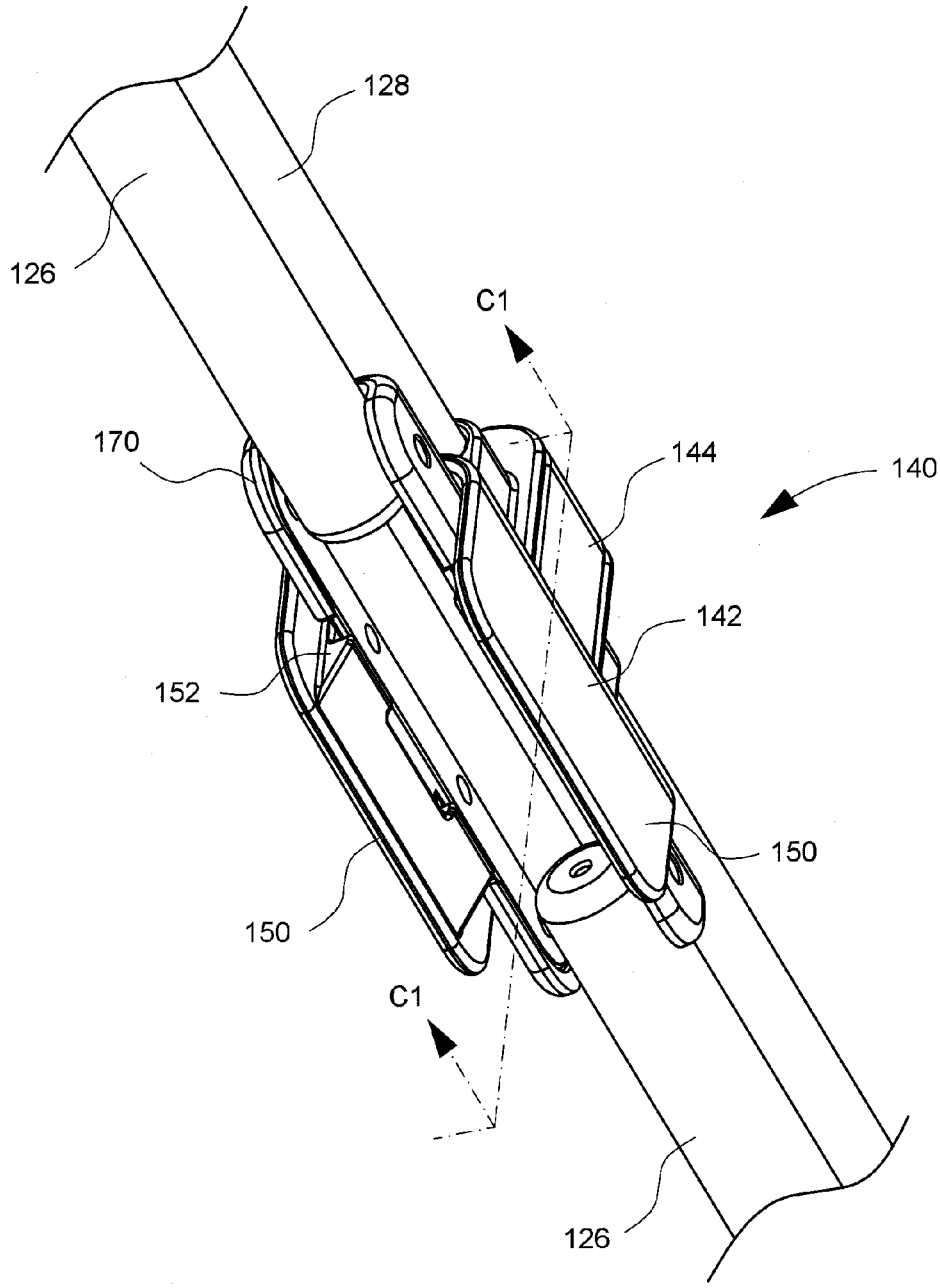
FIG. 11 is an enlarged view illustrating how an additional fixture provided on the child holding accessory attaches with an upper handrail of the support frame.
Figure 12:
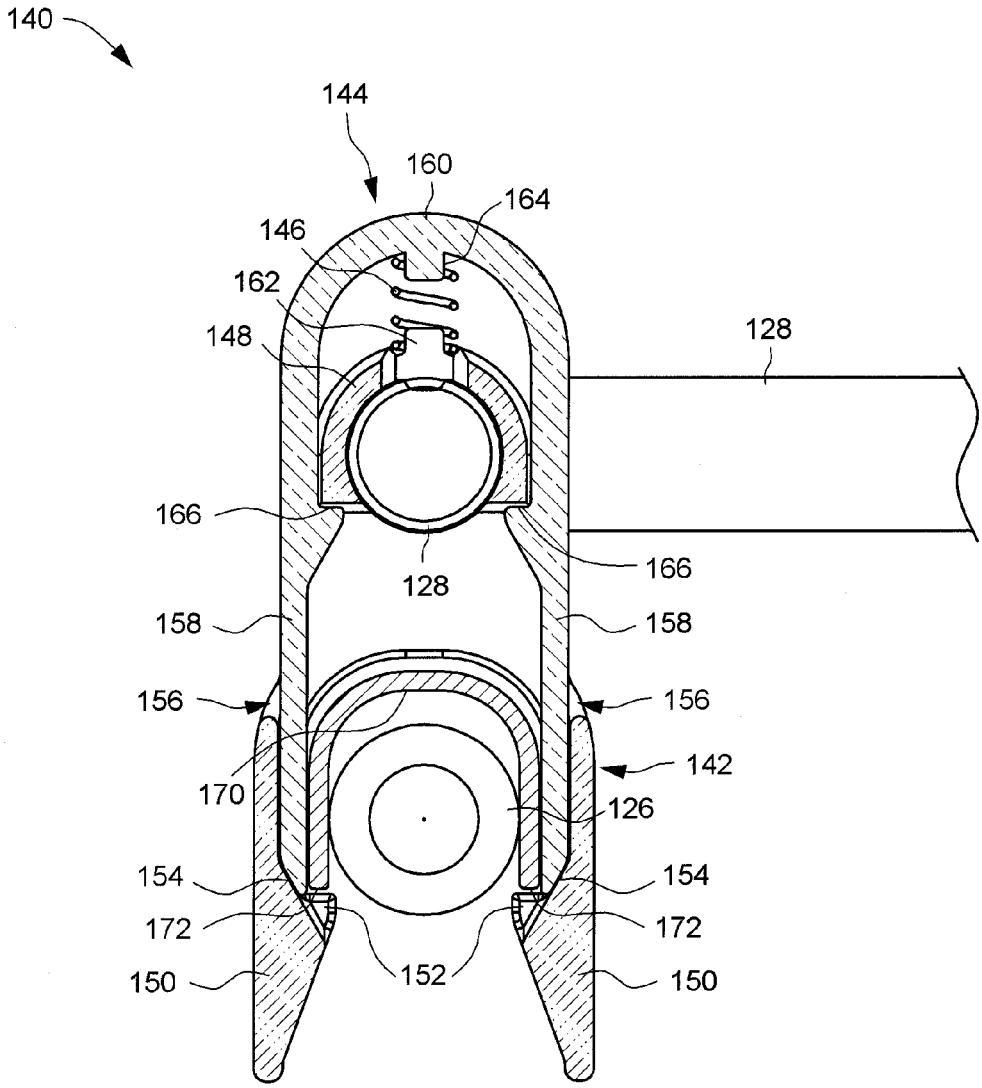
FIG. 12 is a cross-sectional view taken along section C1-C1 shown in FIG. 11.

As shown in FIGS. 11 and 12, a joining sleeve 170 may be provided in the assembly of the upper handrails 126 at each of the two sides 106B of the support frame 106. The clamp 142 of the fixture 140 can engage with the joining sleeve 170 to lock the second side portion 114B of the resting support 114 with the support frame 106. In the locked state, the flanges 152 of the clamp 142 can respectively contact with the distal end edges of the joining sleeve 170 to block disengagement of the fixture 140.

To unlock the fixture 140, the release button 144 can be pushed down so that the push portions 158 can respectively push against the angled surfaces 154 and cause the catch portions 150 to deflect laterally away from each other. As a result, the flanges 152 of the clamp 142 can disengage from the distal end edges 172 of the joining sleeve 170 to unlock the fixture 140.

With the additional fixture 140, the child holding accessory 102 can be securely attached with at least three sides of the support frame 106 to provide stable support. While the aforementioned embodiments provide a child holding accessory 102 that can be adjusted to occupy two different areas A1 and A2 above the play yard 104 (as shown in FIGS. 6 through 8), the child holding accessory may also be constructed to adjustably rotate within a same area of the play yard.

Figure 13:
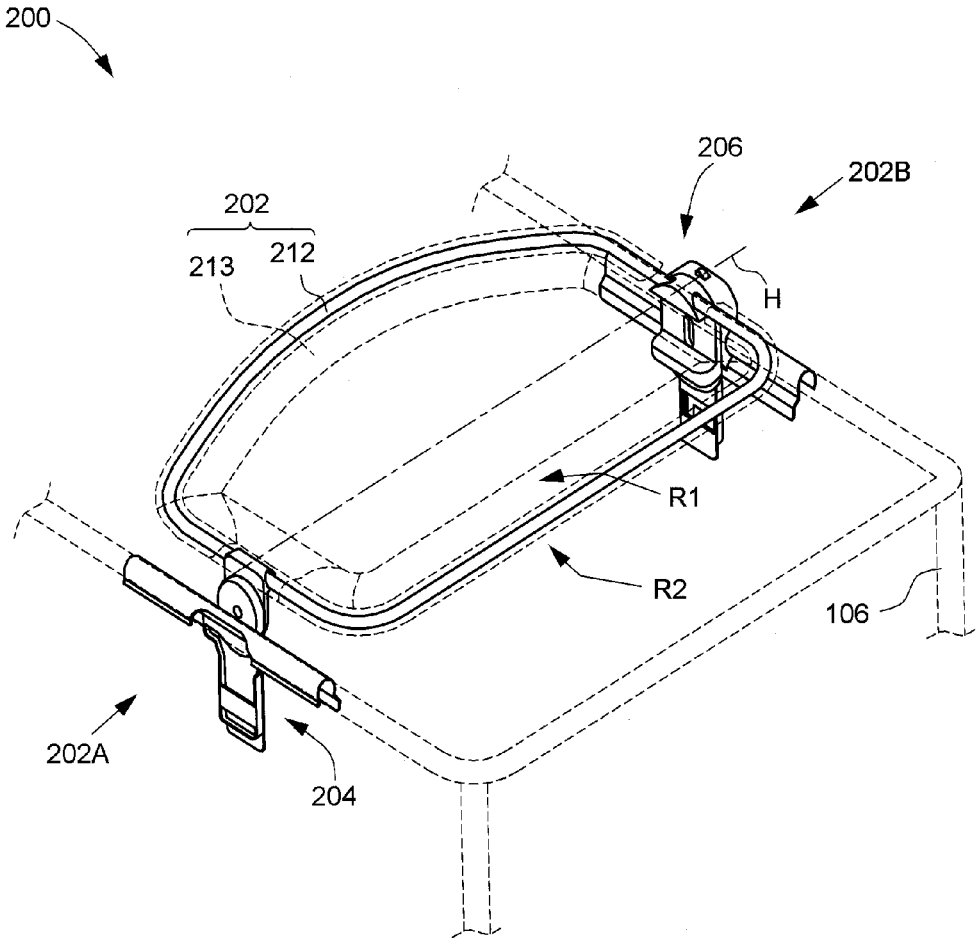
FIG. 13 is a perspective view illustrating a second embodiment of a child holding accessory having multiple regions adapted to receive a child.

FIG. 13 is a schematic view illustrating the construction of another child holding accessory 200 integrating two regions on opposite sides adapted to receive a child. The child holding accessory 200 includes a resting support 202, and fixtures 204 and 206 for attaching the resting support 202 with the support frame 106 of the play yard (shown with phantom lines). The resting support 202 can include a surrounding frame 212 formed from multiple tubular segments connected together. Soft and/or flexible materials 213 (shown with phantom lines) capable of sustaining the weight of a child can be stretched and fixedly secured with the surrounding frame 212 to define the regions R1 and R2. The fixtures 204 and 206 can be provided at positions respectively adjacent to the middle of two opposite sides 202A and 202B of the resting support 202, such that the resting support 202 can rotate about a rotation axis that is vertically aligned with a center line H passing through a middle of the resting support 202.

Figure 14:
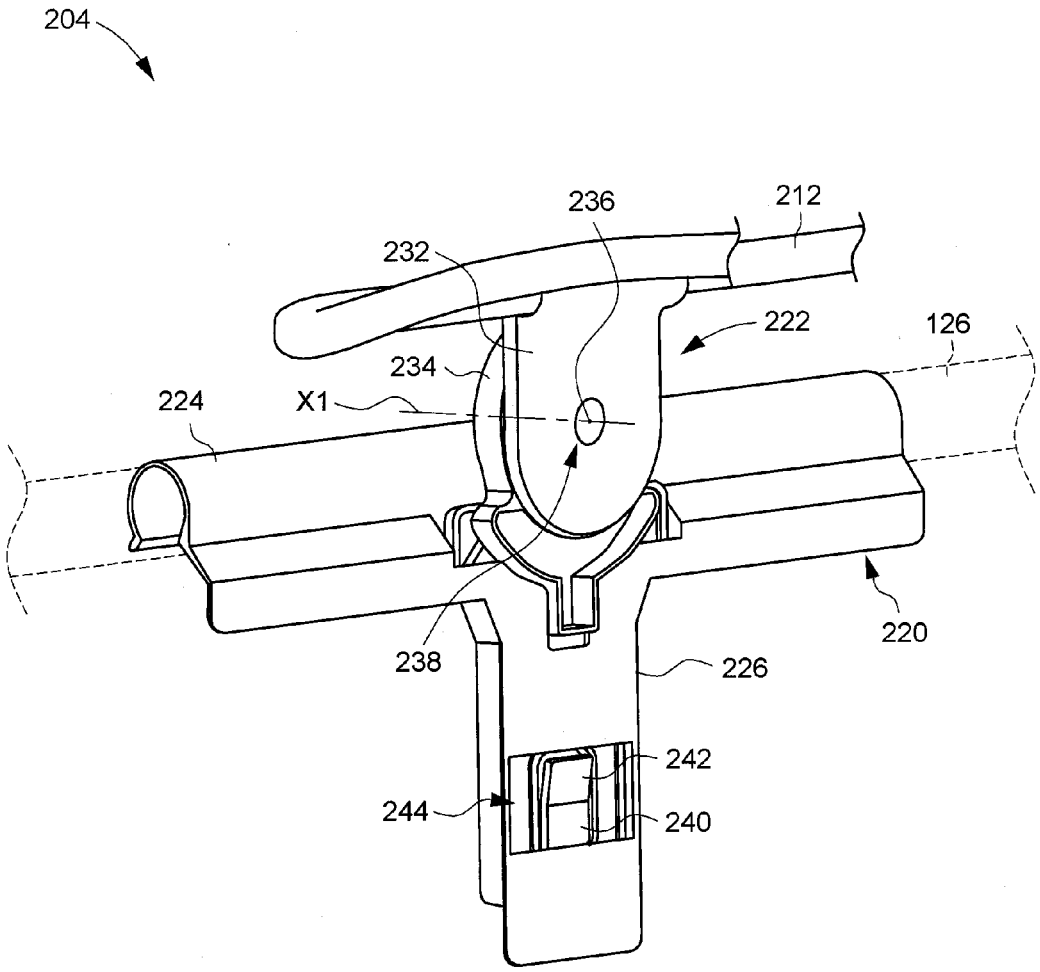
FIG. 14 is a schematic view illustrating a first fixture used to attach the child holding accessory shown in FIG. 13 with a play yard.

FIG. 14 is a schematic view of the fixture 204. The fixture 204 can include a clamp 220 adapted to fasten with the support frame 106, and an adjustable coupling structure 222 that can connect the resting support 202 with the clamp 220. The clamp 220 can have a generally T-shape including a transverse catch portion 224, and a socket 226 extending downward from the catch portion 224. The catch portion 224 can resiliently deform to clamp and unclamp one upper handrail 126 of the support frame 106. The socket 226 can detachably mount with the adjustable coupling structure 222, so that the side 202A of the resting support 202 can be easily detached from the clamp 220 which may be kept attached with the support frame 106.

In an embodiment, the adjustable coupling structure 222 can include a first coupling element 232 connected with the resting support 202, and a second coupling element 234 adapted to detachably connect with the clamp 220. The first coupling element 232 can be affixed with the surrounding frame 212 at the side 202A of the resting support 202. The second coupling element 234 can include a protruding shaft portion 236 that is assembled through a hole 238 of the first coupling element 232 to define a pivot axis X1 about which the first coupling element 232 can rotate relative to the second coupling element 234. The second coupling element 234 can also include a tongue portion 240 provided with a resilient latch 242. The tongue portion 240 can insert through the socket 226 until the resilient latch 242 engages through an opening 244 formed on a sidewall of the socket 226 to securely fasten the adjustable coupling structure 222 with the clamp 220. If needed, the resilient latch 242 can be pushed inward to disengage from the opening 244, whereby the adjustable coupling structure 222 can be removed from the clamp 220.

Figure 15:
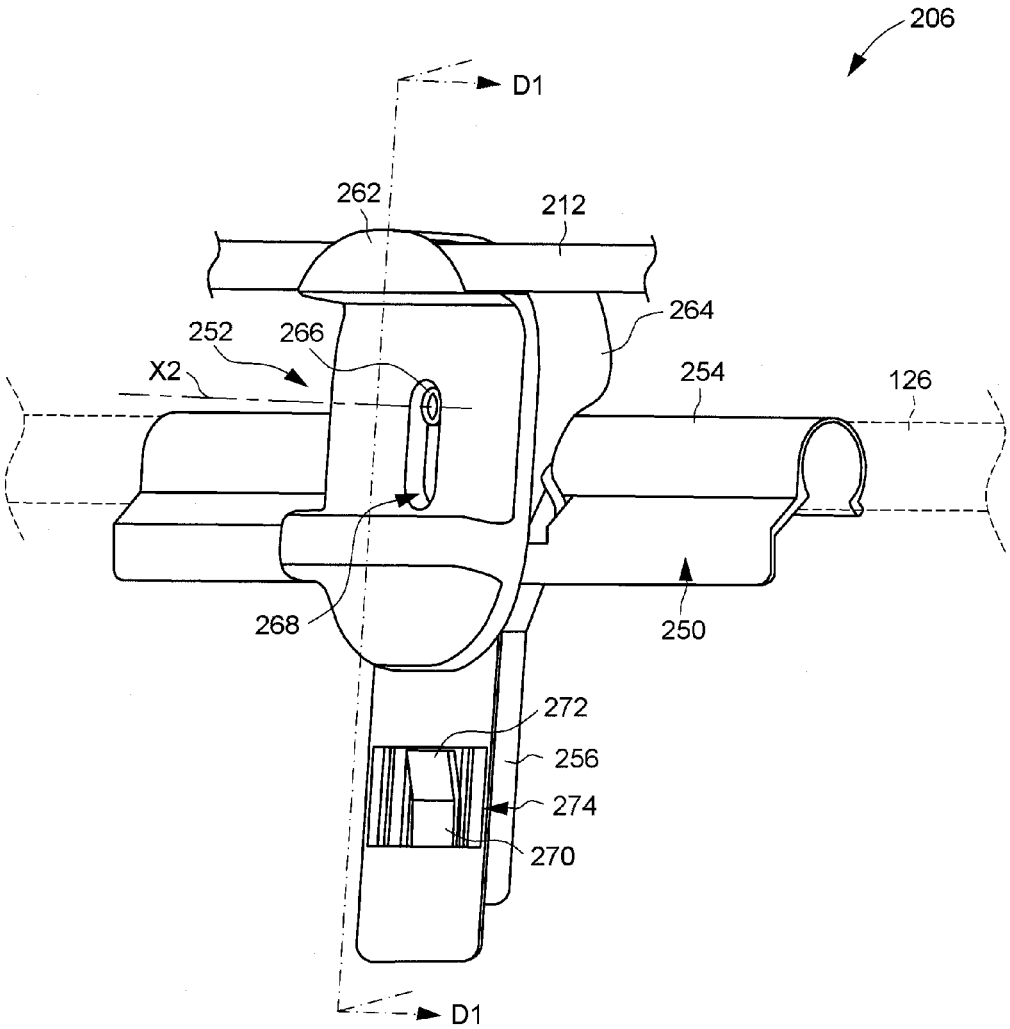
FIG. 15 is a schematic view illustrating a first side of a second fixture used to attach the child holding accessory shown in FIG. 13 with a play yard.
Figure 16:
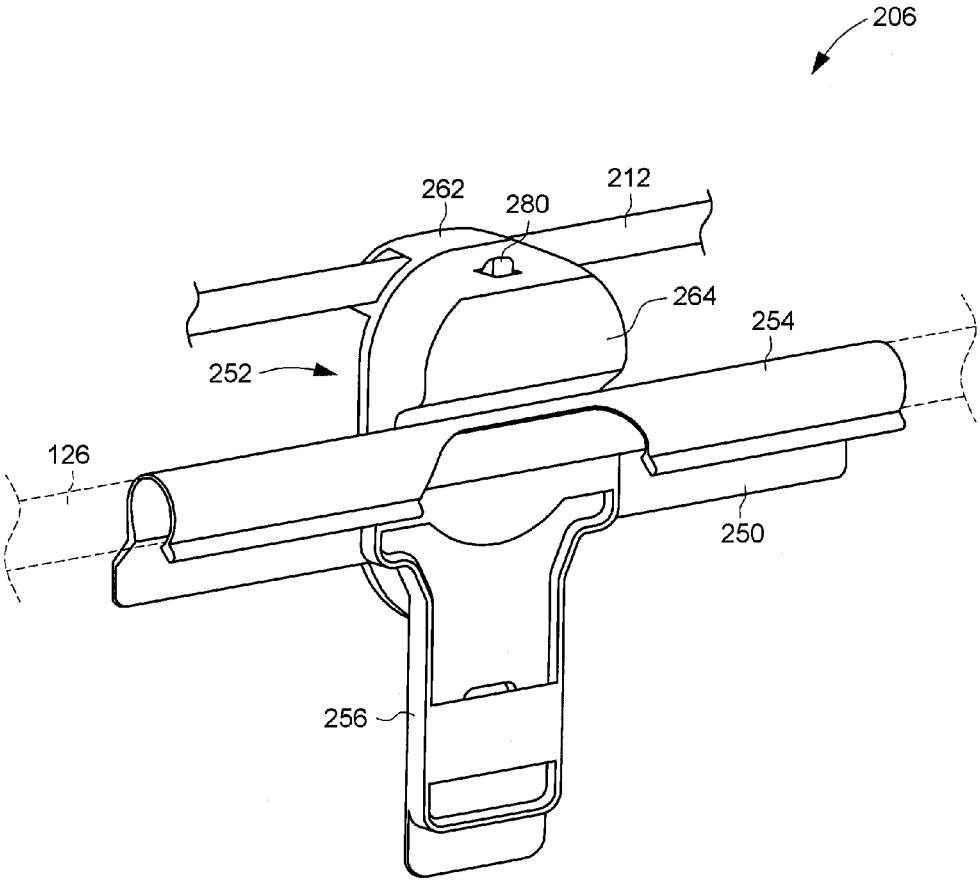
FIG. 16 is a schematic view illustrating a second side of the second fixture used to attach the child holding accessory shown in FIG. 13 with a play yard.
Figure 17:
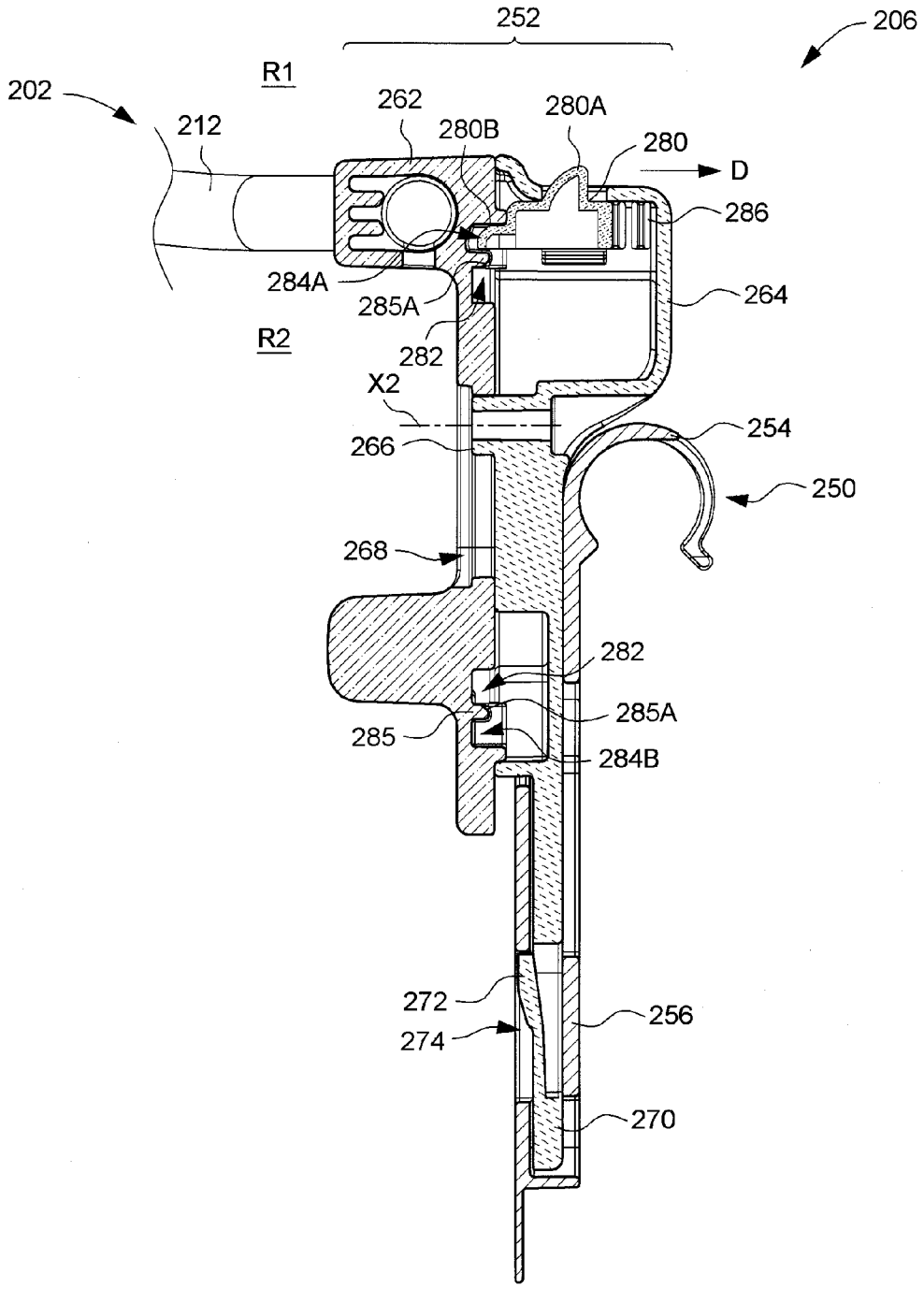
FIG. 17 is a cross-sectional view of the second fixture taken along section D1-D1 shown in FIG. 15.

FIGS. 15 and 16 are schematic views illustrating two opposite sides of the fixture 206 provided at the side 202B of the resting support 202, and FIG. 17 is a cross-sectional view taken along section D1-D1 shown in FIG. 15. The fixture 206 can include a clamp 250 adapted to fasten with the support frame 106, and an adjustable coupling structure 252 that can connect the resting support 202 with the clamp 250. The clamp 250 can have a generally T-shape including a transverse catch portion 254, and a socket 256 extending downward from the catch portion 254. The catch portion 254 can be formed with a generally C-shape that can resiliently deform to clamp and unclamp the associated upper handrail 126 of the support frame 106. The socket 256 is adapted to detachably mount with the adjustable coupling structure 252, whereby the side 202B of the resting support 202 can be easily detached from the clamp 250 while the clamp 250 is kept attached with the support frame 106.

The adjustable coupling structure 252 can include a first coupling element 262 connected with the resting support 202, and a second coupling element 264 adapted to detachably connect with the clamp 250. The first coupling element 262 can be affixed with the surrounding frame 212 at the side 202B of the resting support 202. The second coupling element 264 can include a circular shaft portion 266 that is assembled through a slot 268 of the first coupling element 262 to define a pivot axis X2 about which the first coupling element 262 can rotate relative to the second coupling element 264. The slot 268 can have a width substantially equal to the diameter of the shaft portion 266, and a length greater than the shaft portion 266. Relative displacement of the shaft portion 266 along the length of the slot 268 is thereby permitted to guide vertical movements of the first coupling element 262 relative to the second coupling element 264.

The second coupling element 264 can also include a tongue portion 270 provided with a resilient latch 272. The tongue portion 270 can insert through the socket 256 until the resilient latch 272 engages through an opening 274 formed on a sidewall of the socket 256. The coupling structure 252 can be thereby fastened with the clamp 250 to form the fixture 206. If needed, the resilient latch 272 can be pushed inward to disengage from the opening 274, whereby the adjustable coupling structure 252 is removed from the clamp 250 to disassemble the fixture 206.

As better shown in FIG. 17, the adjustable coupling structure 252 can also include a latching element 280 that is designed to block rotation of the first coupling element 262 about the pivot axis X2 in two positions: a first position where the first region R1 of the resting support 202 is turned upward for use, and a second position where the opposite second region R2 of the resting support 202 is turned upward for use. Moreover, an inner surface of one of the coupling elements 262 and 264 (for example, the first coupling element 262) can include a circular guide track 282 placed around the pivot axis X2, and two locking positions (e.g., formed as recessed grooves 284A and 284B) that are diametrically opposite to each other relative to the center of the guide track 282 and are located farther from the center than the guide track 282. The guide track 282 is separated from the grooves 284A and 284B by a sidewall 285 having an angled edge 285A.

The latching element 280 can be mounted in an inner cavity between the first and second coupling elements 262 and 264, and is movable along an axis parallel to the pivot axis X2. A spring 286 can be connected between the latching element 280 and the second coupling element 264, and is adapted to bias the latching element 280 toward the first coupling element 262. The spring 286 and the latching element 280 can be formed as an integral part by plastic injection molding. The latching element 280 can also include an actuator portion 280A that can protrude outward from the second coupling element 264 for facilitating operation of the latching element 280, and an angled tip 280B adapted to engage with either of the guide track 282 and one of the grooves 284A and 284B.

It is worth noting that the engagement of the latching element 280 may also accomplished by interchanging the positions of the guide track 282 and grooves 284A and 284B with respect to the first and second coupling element, for example, the guide track 282 and grooves 284A and 284B can also be disposed on the second coupling element 264.

Figure 18:
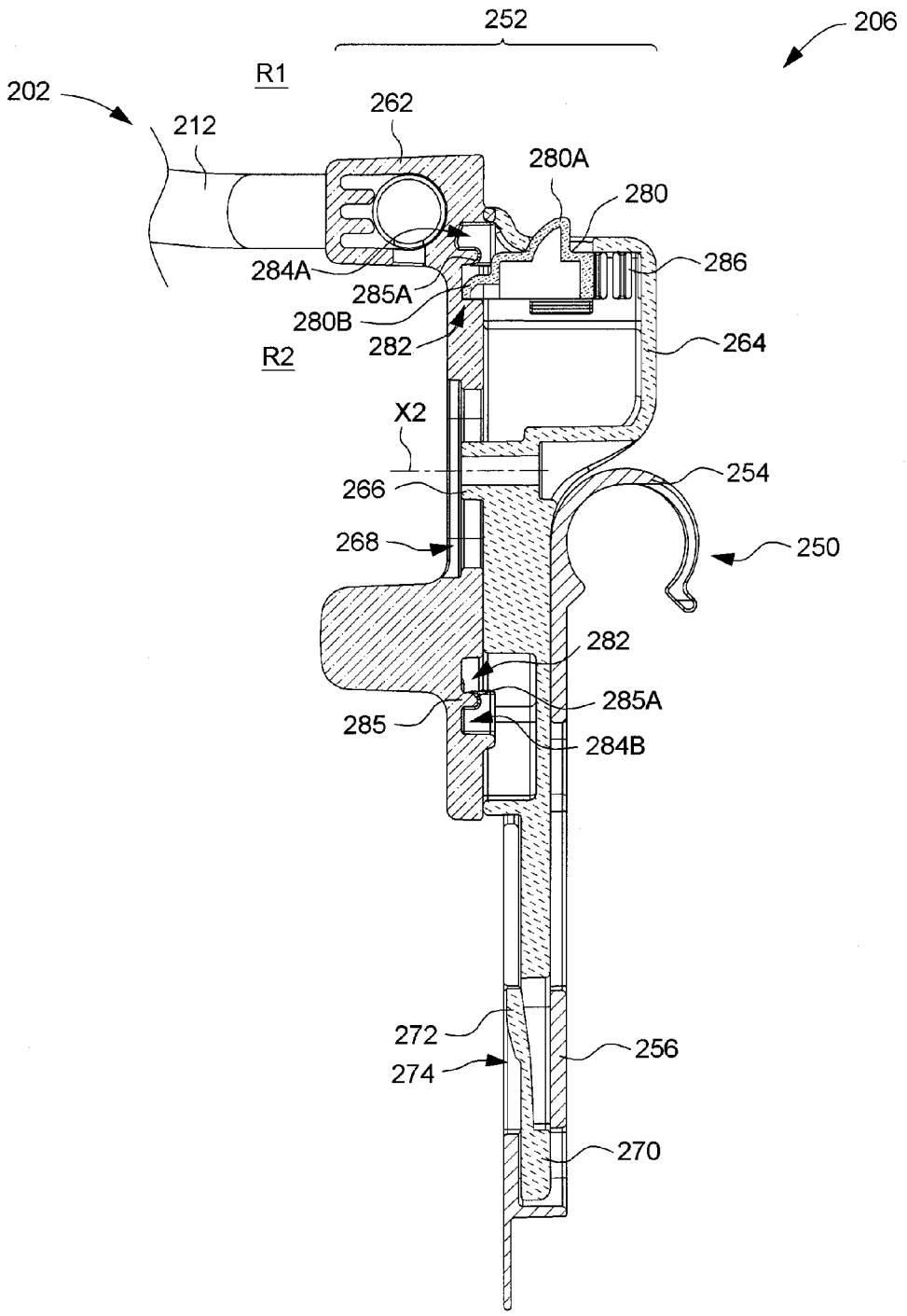
FIGS. 18 and 19 are schematic views illustrating an exemplary operation of the second fixture for adjusting the orientation of the resting support.
Figure 19:
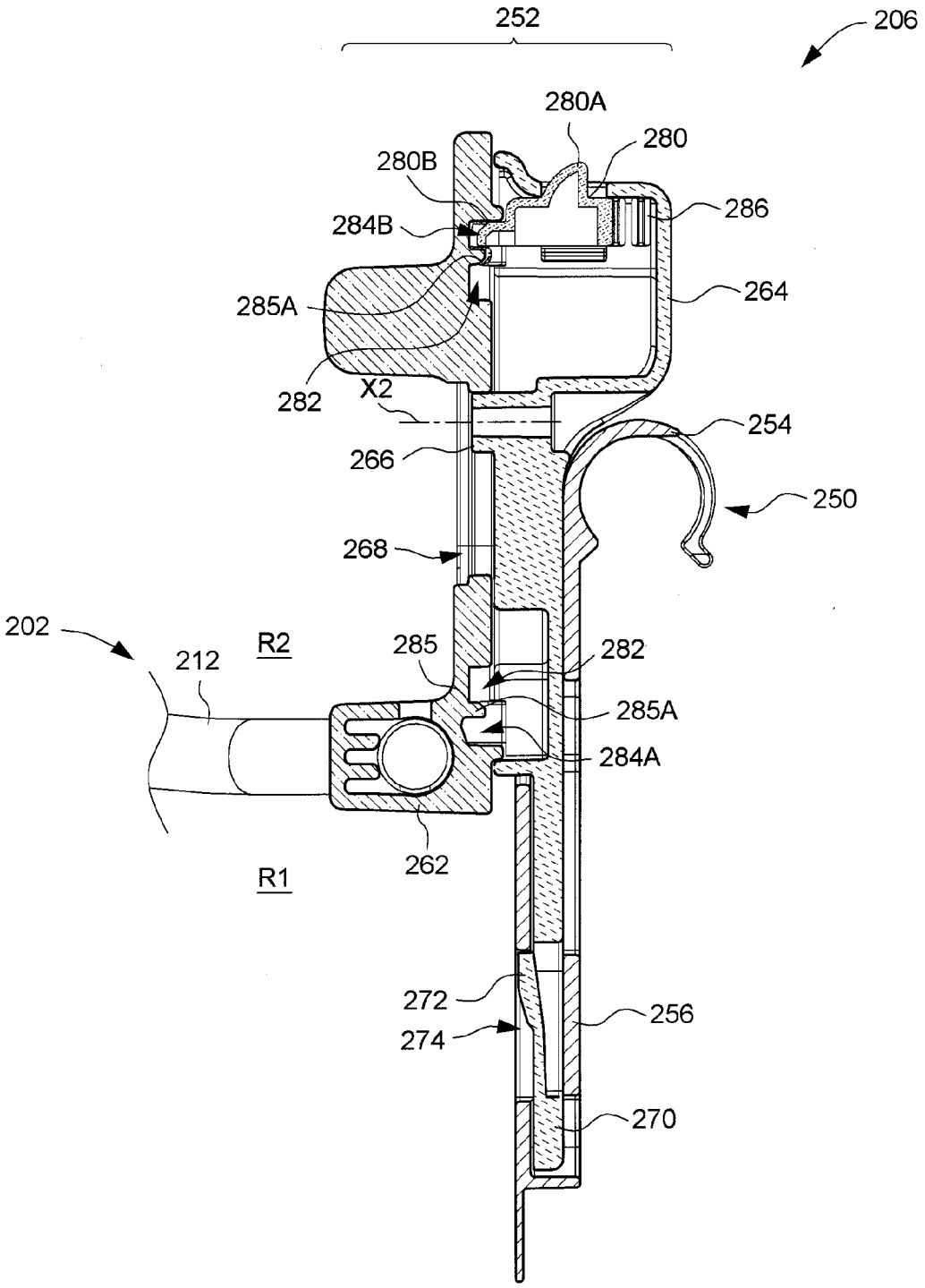
Figure 20:
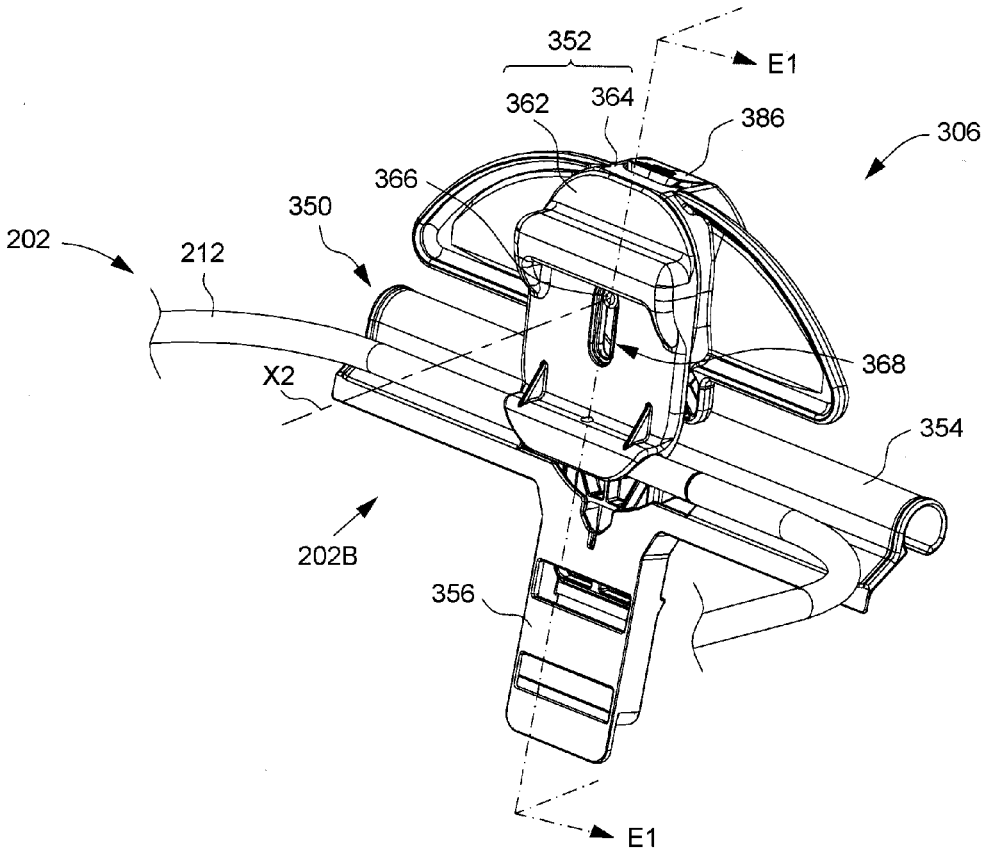
FIG. 20 is a perspective view illustrating another embodiment of a fixture used to attach a child holding accessory with a play yard.

Exemplary operation for adjusting the orientation of the resting support 202 is described hereafter with reference to FIGS. 17 through 19. In FIG. 17, suppose that the child holding accessory 200 is installed on the play yard 104 with the first region R1 turned upward. In this configuration, the latching element 280 can engage with the groove 284A to block rotation of the resting support 202 and hold it in place.

In case the resting support 202 is to be adjusted to turn the second region R2 upward, the actuator portion 280A may be pushed toward the second coupling element 264 (as shown by the arrow D) to disengage the latching element 280 from the groove 284A. The side 202B of the resting support 202 then can be slightly pulled so that the first coupling element 262 moves upward relative to the second coupling element 264, until the latching element 280 engages with the guide track 282 under the biasing action of the spring 286. The engagement of the latching element 280 with the guide track 282 in shown in FIG. 18. In this position, the center of the guide track 282 is substantially aligned with the pivot axis X2. The resting support 202 then can be rotated about the pivot axes X1/X2 until the second region R2 is turned upward, which also turns the groove 284B to an upward position adjacent to the latching element 280.

Once the second region R2 is properly oriented, the resting support 202 can be pushed downward, which causes the first coupling element 262 to push the latching element 280 toward the second coupling element 264 and disengage from the guide track 282 owing to the interaction of the angled edge 285A and the angled tip 280B of the latching element 280. Once the groove 284B becomes aligned with the latching element 280, the spring 286 can push the latching element 280 to engage with the groove 284B to lock the resting support 202 in place, as shown in FIG. 19.

FIGS. 20 through 27 are schematic views illustrating the construction of another fixture 306 that is a variant construction of the previous fixture 206 provided at the side 202B of the resting support 202. Like the fixture 206 previously described, the fixture 306 of this embodiment can include a clamp 350 adapted to fasten with the support frame 106, and an adjustable coupling structure 352 that can connect the resting support 202 with the clamp 350. The clamp 350 can have a generally T-shape including a transverse catch portion 354, and a socket 356 adapted to detachably mount with the adjustable coupling structure 352 to allow easy detachment of the side 202B of the resting support 202 from the clamp 350.

The adjustable coupling structure 352 can include a first coupling element 362 connected with the surrounding frame 212 of the resting support 202, and a second coupling element 364 adapted to detachably connect with the clamp 350. The first coupling element 362 can be affixed with the surrounding frame 212 at the side 202B of the resting support 202. The second coupling element 364 can include a circular shaft portion 366 that is assembled through a slot 368 of the first coupling element 362 to define a pivot axis X2 about which the first coupling element 362 can rotate relative to the second coupling element 364. The slot 368 can have a width substantially equal to the diameter of the shaft portion 366, and a length greater than the diameter of the shaft portion 366. Relative displacement of the shaft portion 366 along the length of the slot 368 is thereby permitted to guide vertical movements of the first coupling element 362 relative to the second coupling element 364.

Figure 21:
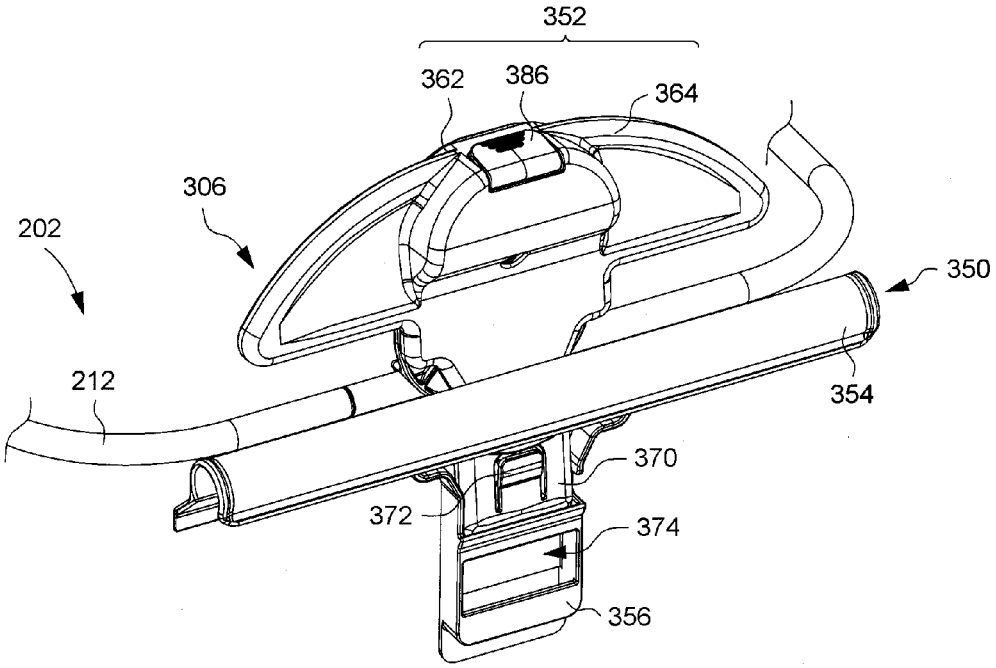
FIG. 21 is a perspective view illustrating the fixture shown in FIG. 20 from an opposite side.

As better shown in FIG. 21, the second coupling element 364 can also include a tongue portion 370 provided with a resilient latch 372. The tongue portion 370 can insert through the socket 356 until the resilient latch 372 engages through an opening 374 formed on a sidewall of the socket 356 (for clarity, the figures show the resilient latch 372 disengaged from the opening 374). The coupling structure 352 can be thereby fastened with the clamp 350 to form the fixture 306.

Figure 22:
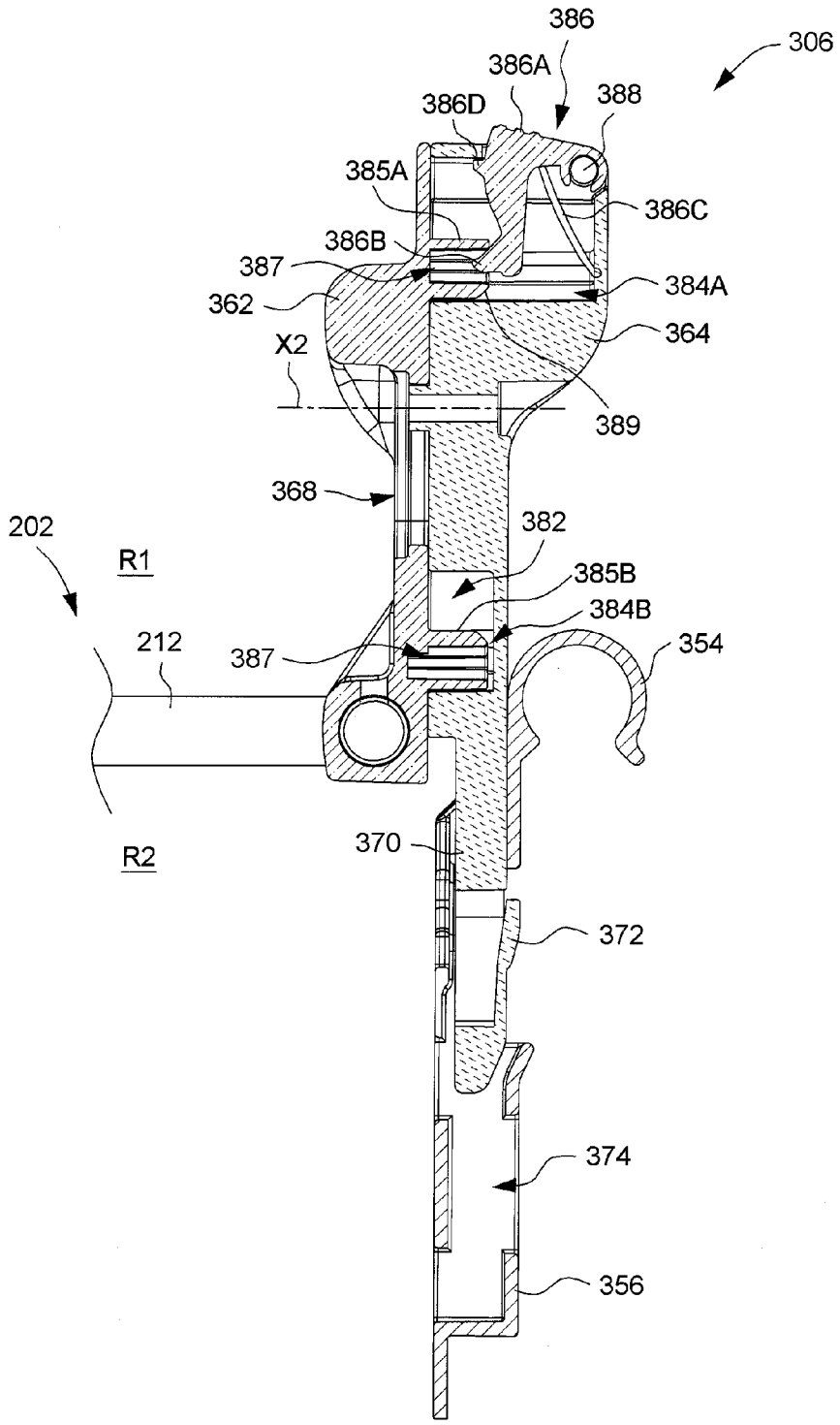
FIG. 22 is a cross-sectional view of the fixture shown in FIG. 20 taken along section E1-E1.
Figure 23:
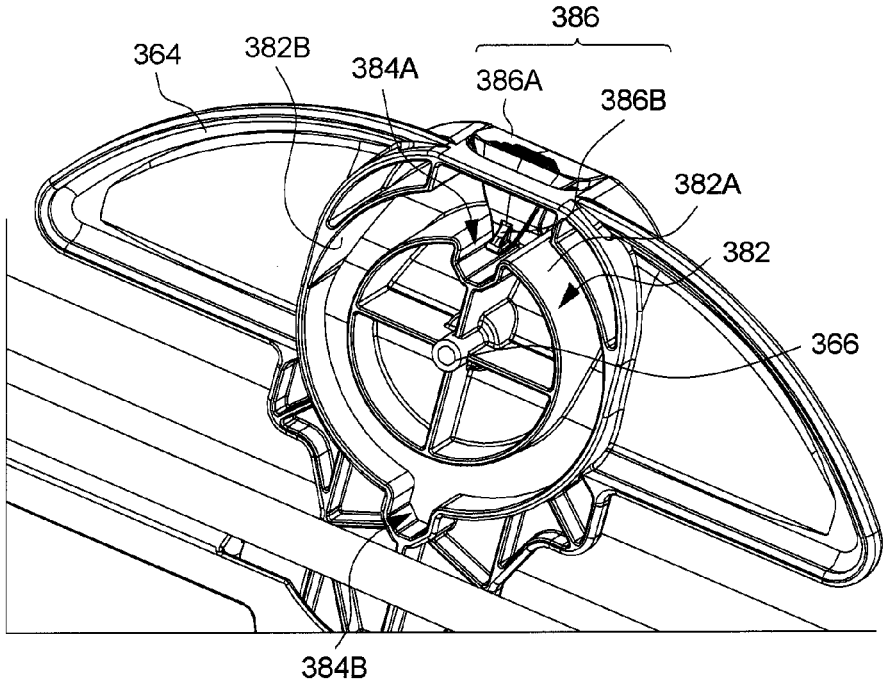
FIGS. 23 and 24 are schematic views respectively showing an inner side of two coupling elements used in the fixture of FIG. 20.
Figure 24:
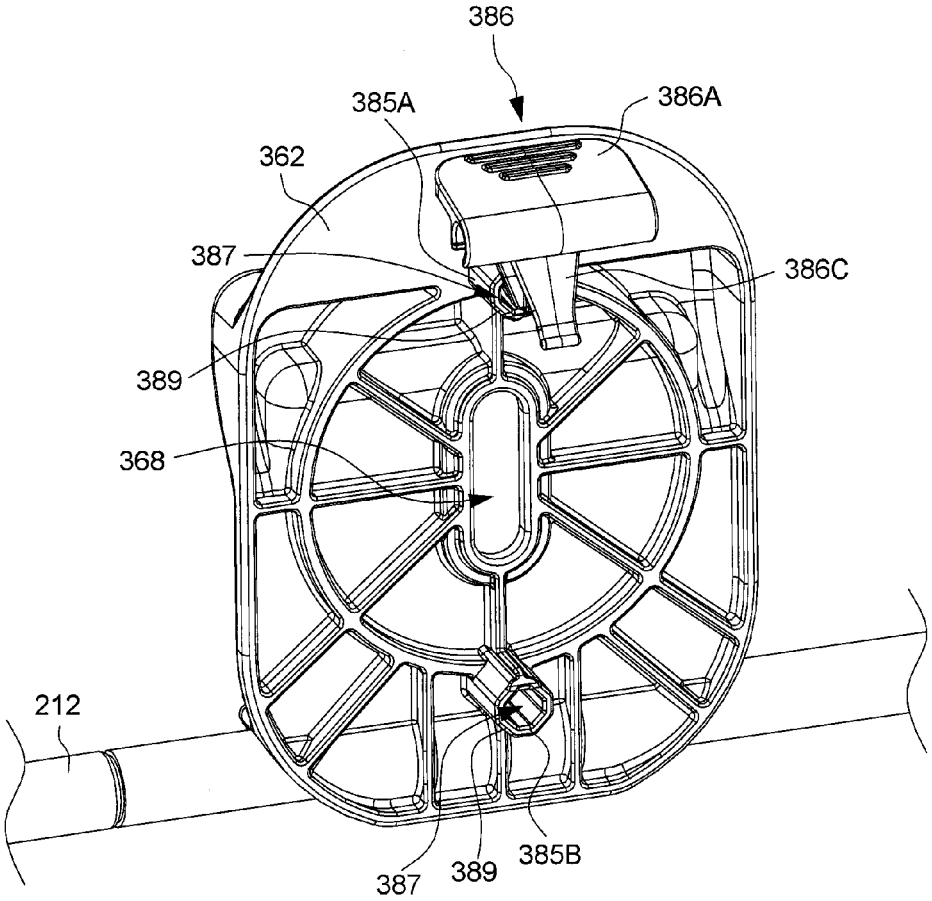

FIG. 22 is a cross-sectional view illustrating the assembly of the first coupling element 362 with the second coupling element 364, and FIGS. 23 and 24 are schematic views respectively showing an inner side of the first and second coupling elements 362 and 364. As better shown in FIG. 23, an inner side of one of the coupling elements 362 and 364 (for example, the second coupling element 364) can include a circular guide track 382 centered on the pivot axis X2, and two locking positions (e.g., formed as recessed grooves 384A and 384B) that are opposite to each other relative to the center of the guide track 382. The guide track 382 can be defined between an inner wall 382A and an outer wall 382B. The two recessed grooves 384A and 384B may be formed at positions that are offset downward from two diametrically opposite locations on the inner wall 382A and outer wall 382B, respectively.

As better shown in FIG. 24, an inner side of the other coupling element (i.e., the first coupling element 362 in the illustrated example) can include two index posts 385A and 385B that are placed at two opposite sides of the slot 368 and are substantially aligned with the length direction of the slot 368. The distance between the index posts 385A and 385B is substantially equal to the diameter of the circular guide track 382 as well as the distance between the two recessed grooves 384A and 384B. During operation, the index posts 385A and 385B can be movably placed into sliding contact against the guide track 382 to facilitate the rotation of the first coupling element 362 relative to the second coupling element 364. Moreover, the index posts 385A and 385B can also operatively engage with the recessed grooves 384A and 384B to block rotation of the first coupling element 362 relative to the second coupling element 364, whereby the resting support 202 can be locked in position with either of the first and second region R1 and R2 oriented upward for use.

It is worth noting that the above locking engagement for holding the resting support 202 in place may also be achieved by interchanging the positions of index posts 385A and 385B and the guide track 382 and two recessed grooves 384A and 384B with respect to the first and second coupling elements. For example, the guide track 382 and the two recessed grooves 384A and 384B can be disposed on the first coupling element 362, and the two index posts 385A and 385B can be disposed on the second coupling element 364.

In addition, the adjustable coupling structure 352 can include a latching element 386 that is assembled in an inner cavity between the first and second coupling elements 362 and 364. In this embodiment, the latching element 386 can be mounted adjacent to the position of the recessed groove 384A, and pivotally connected with the second coupling element 364 via a pivot connection 388. The latching element 386 can include an actuator portion 386A that is accessible from an upper side of the second coupling element 364, and a tip 386B adapted to engage with either of the index posts 385A and 385B, for example by engaging through an opening 387 formed through each of the posts 385A and 385B. A spring element, such as resilient arm 386C, may also be provided to bias the latching element 386 into locking engagement with either of the index posts 385A and 385B. The latching element 386 may also have a stop protrusion 386D that can abut against an inner edge of the first coupling element 362 to restrict the range of displacement of the latching element 386 when biased by the resilient arm 386C. In one embodiment, the resilient arm 386C and the stop protrusion 386D may be integrally formed with the latching element 386, and have a distal end abutting against an inner sidewall of the second coupling element 364.

Exemplary operation of the fixture 306 is described hereafter with reference to FIGS. 22, and 25 through 27. In FIG. 22, suppose that the child holding accessory is installed on the play yard with the first region R1 turned upward. In this configuration, the index posts 385A and 385B respectively engage with the recessed grooves 384A and 384B to block rotation of the resting support 202. In this position, the center point between the index posts 385A and 385B can be offset downward from the pivot axis X2. Moreover, the biasing action of the resilient arm 386C can cause the latching element 386 to engage with the index post 385A to block upward displacement of the first coupling element 362 relative to the second coupling element 634. Accidental raising of the side 202B and flipping of the resting support 202 can be thereby prevented.

Figure 25:
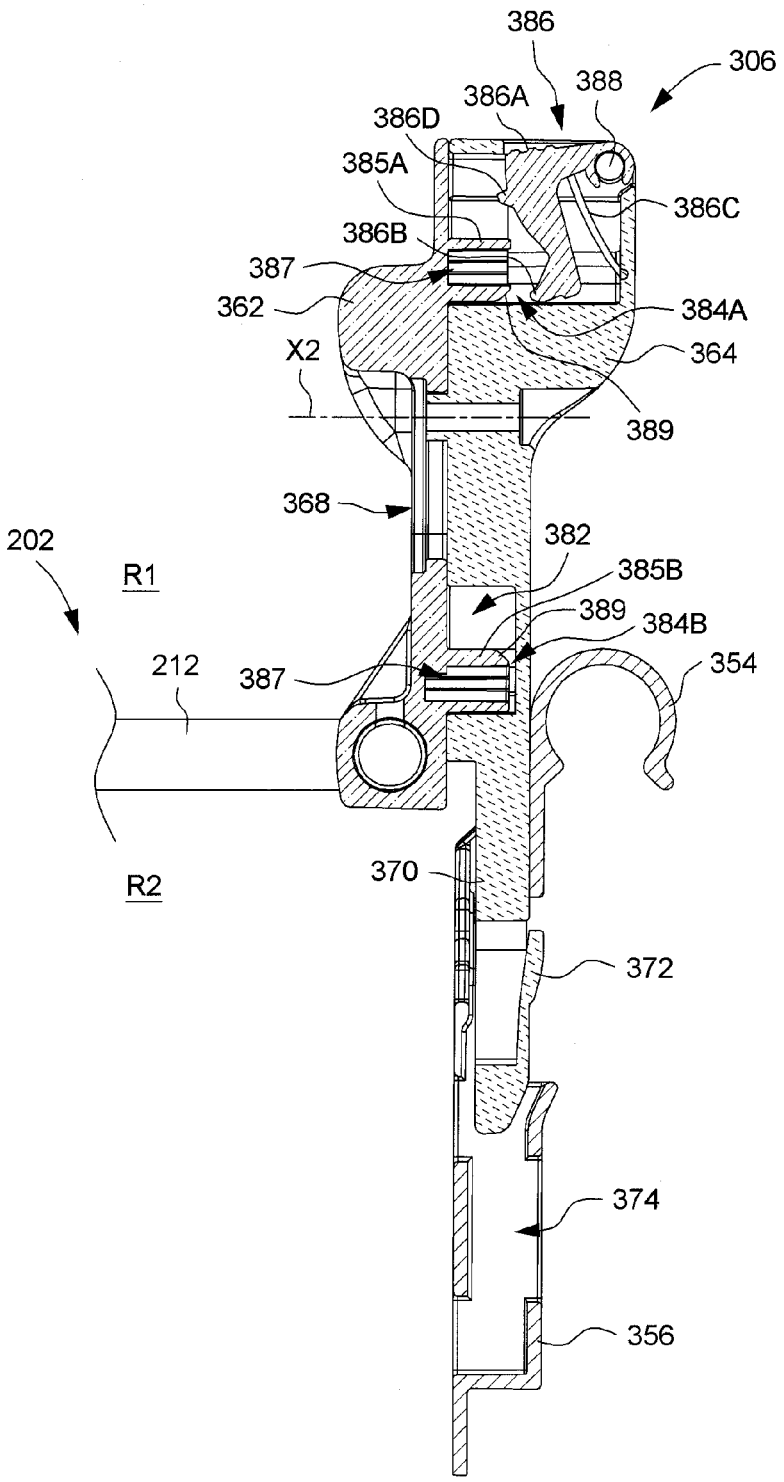
FIGS. 25 through 27 are schematic views illustrating an exemplary operation of the fixture shown in FIG. 20 for adjusting the orientation of the resting support.
Figure 26:
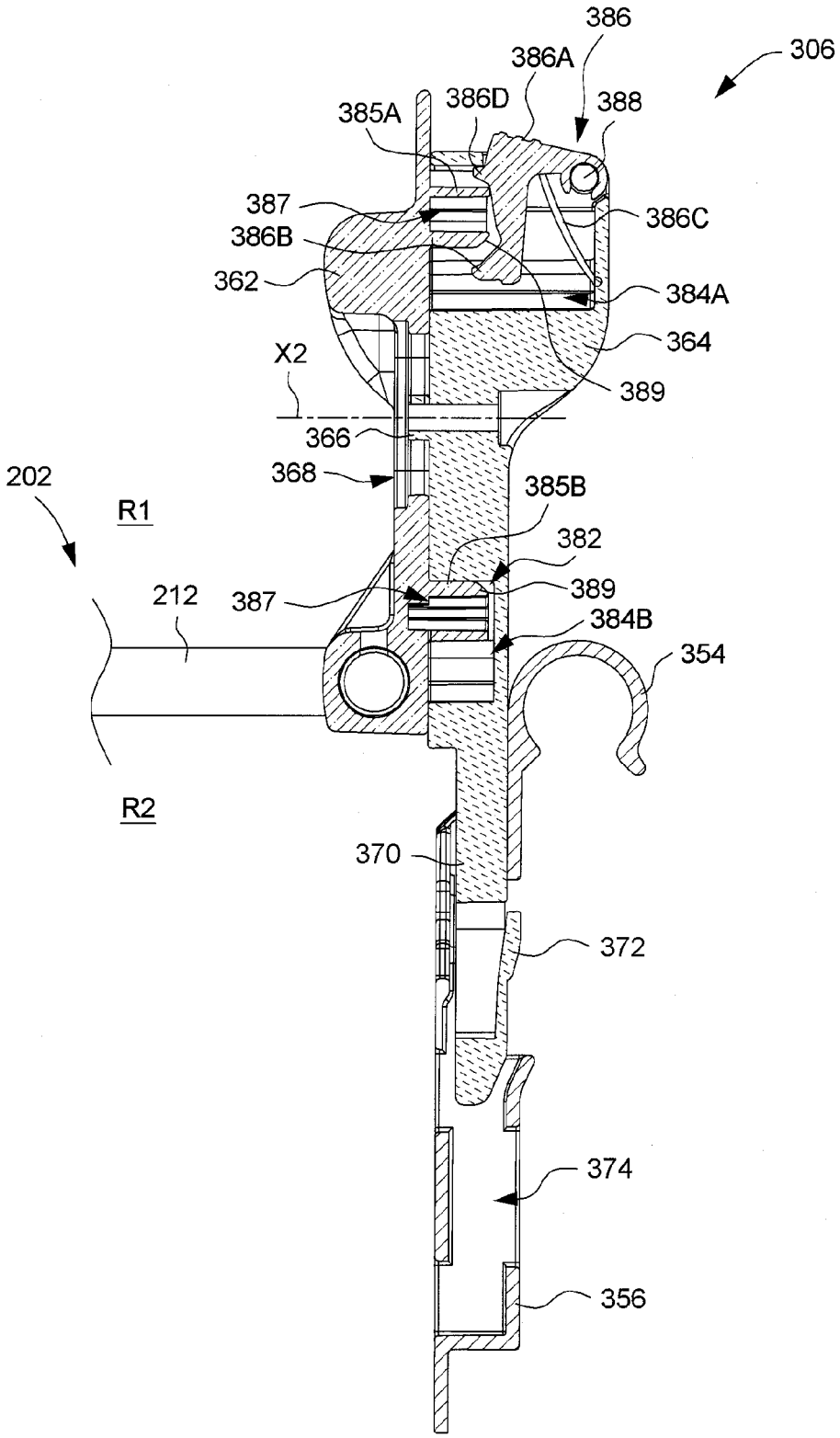

In case the resting support 202 is to be adjusted to turn the second region R2 upward, the actuator portion 386A may be pushed to disengage the latching element 386 from the index post 385A, as shown in FIG. 25. The side 202B of the resting support 202 then can be slightly raised, which cause the first coupling element 362 to move upward relative to the second coupling element 364 until the index posts 385A and 385B respectively disengage from the recessed grooves 384A and 384B, as shown in FIG. 26. In this position, the center point between the index posts 385A and 385B can be substantially aligned with the pivot axis X2, and the lower index post 385B can be in contact with the guide track 382. Guided by the sliding contact between the index posts 385A and 385B and the guide track 382, the resting support 202 then can be rotated about the pivot axes X1/X2 until the second region R2 is turned upward, which corresponds to a configuration where the index posts 385A and 385B are respectively aligned with the recessed grooves 384B and 384A. It is worth noting that as the index post 385B approaches the recessed groove 384A during adjustment, an angled edge 389 of the index post 385B can contact and push the latching element 386 away. Accordingly, no pressure on the actuator portion 386A is required, and the latching element 386 can be automatically pushed to a disengaged position by downward pressing of the first coupling element 362.

Figure 27:
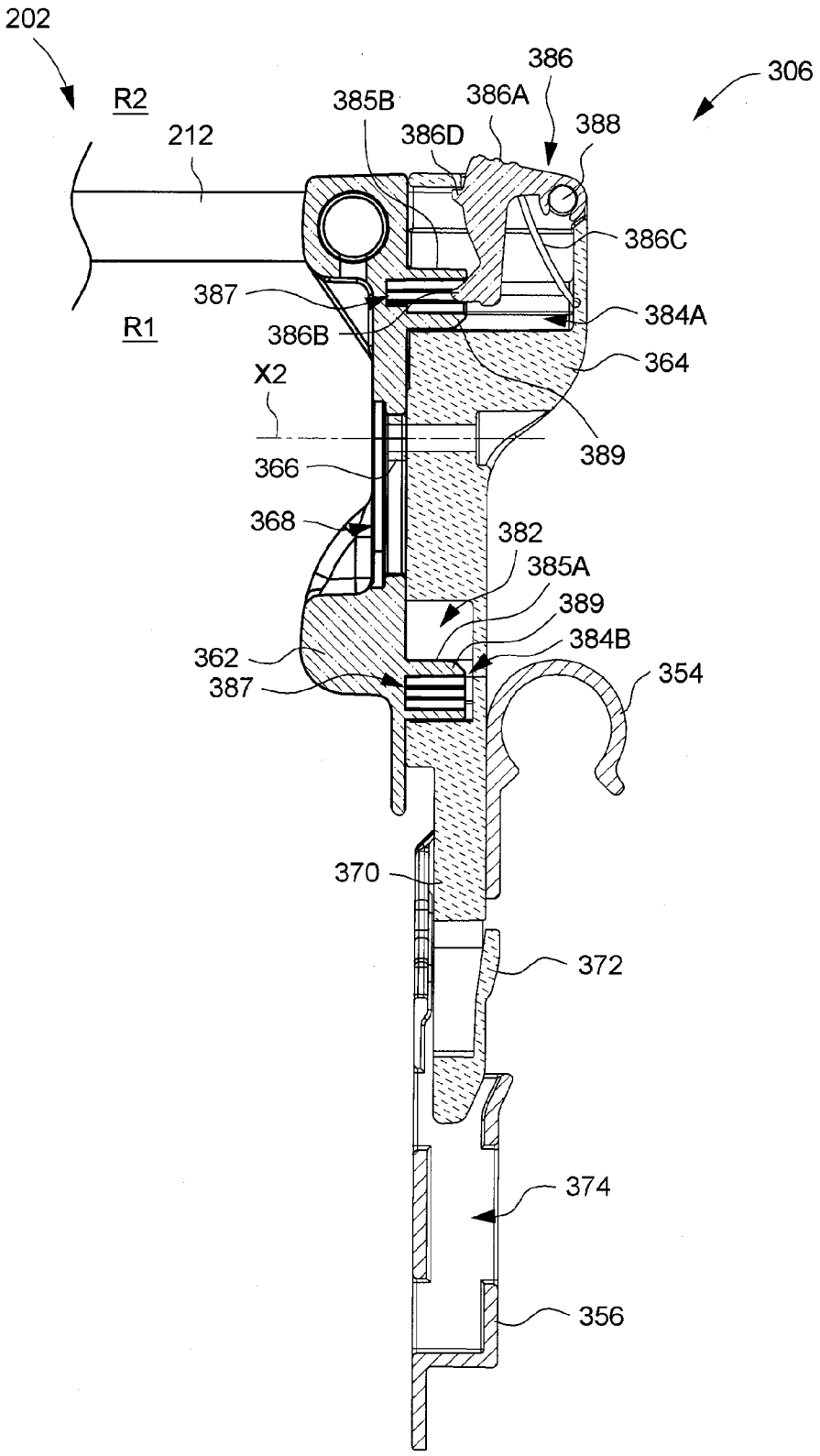

Once the second region R2 is properly oriented, the resting support 202 can be pushed downward, which causes the index posts 385A and 385B to respectively engage with the recessed grooves 384B and 384A for blocking rotation of the resting support 202. As the resting support 202 is being pushed downward, the latching element 386 can also be pushed away by the angled edge 389 of the index post 385B. Once it is properly aligned, the biasing action of the resilient arm 386C can push the latching element 386 to engage with the index post 385B to prevent accidental disengagement of the index posts from their respective recessed grooves, as shown in FIG. 27. With this construction, the latching element 386 can thus self-engage with the index posts 385B when the first coupling element 362 is pressed downward, and no operation of the actuator portion 386A is needed. The aforementioned construction for achieving self-engagement of the latching element 386 when the first coupling element 362 is operated may be provided with respect to both of the index posts 385A and 385B. The same operating steps described above may be repeated to reversely turn the first region R1 upward.

As shown in FIGS. 22 and 27, it can be noted that the resting support 202 may be located at a lower position when the first region R1 is turned upward, and at a higher position when the second region R2 is turned upward. However, the placement of the first and second regions R1 and R2 may be interchanged so that the resting support 202 can be at a higher position when the first region R1 is turned upward, and at a lower position when the second region R2 is turned upward.

With the foregoing construction, the resting support 202 can occupy approximately the same area regardless of whether it is the first or second region R1 or R2 that is currently configured for use. This may reduce the range of movement of the resting support 202 during adjustment.

Figure 28:
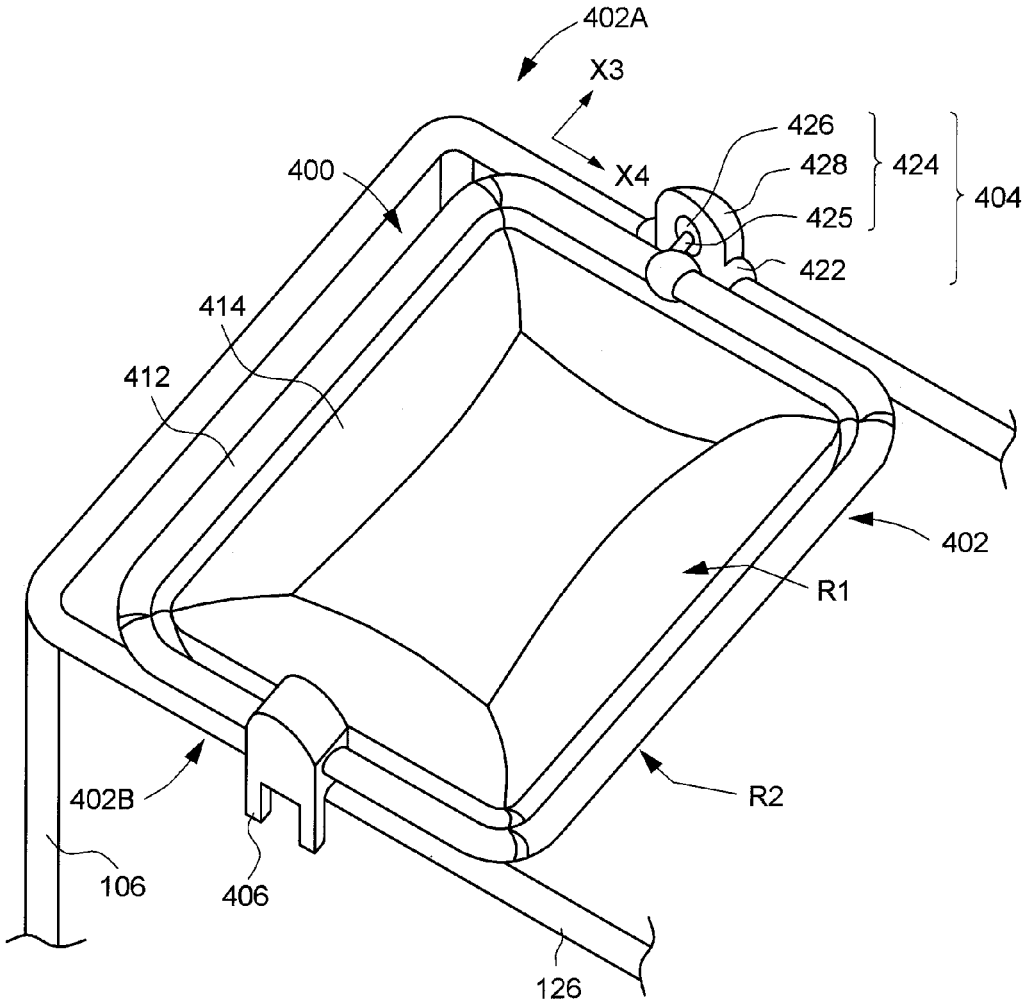
FIG. 28 is a schematic view illustrating a fourth embodiment of child holding accessory having multiple regions adapted to receive a child.

FIG. 28 is a schematic view illustrating another child holding accessory 400 having multiple regions adapted to receive the placement of a child. The child holding accessory 400 likewise includes a resting support 402, and fixtures 404 and 406 for attaching the resting support 402 with the support frame 106 of the play yard. The resting support 402 can include a surrounding frame 412 formed from the assembly of multiple tubular segments to which flexible materials 414 capable of sustaining the weight of a child (shown with dotted lines) can be attached to define the regions R1 and R2. The fixtures 404 and 406 can be respectively provided at positions adjacent to the middle of two opposite sides 402A and 402B of the resting support 402.

The fixture 404 can include a clamp 422 adapted to removably attach with the play yard, and an adjustable coupling structure 424 that connects the resting support 402 with the clamp 422. The adjustable coupling structure 424 can be formed as a ball and socket joint. For example, the adjustable coupling structure 424 can include a coupling arm 425 that is affixed with the surrounding frame 412 and is provided with a ball 426, and a socket 428 formed at an upper portion of the clamp 422 and adapted to engage with the ball 426. With this construction, the resting support 402 can be rotated about a axis X3 to turn upward either of the first and second regions R1 and R2, and rotated about axis X4 to facilitate vertical displacement of the side 402B of the resting support 402 relative to the corresponding side of the support frame 106 to either engage or disengage the fixture 406.

The fixture 406 can be formed as a clamp that is pivotally connected with the surrounding frame 412 and can engage with the corresponding side of the support frame 106. When either of the first region R1 and second region R2 is turned upward, the fixture 406 can be pivoted relative to the frame portion 412 of the resting support 402 to which it is mounted so as to adequately orient the clamp for engaging with the upper handrail 126.

At least one advantage of the structures described herein is the ability to provide a child holding accessory that can integrate two opposite regions adapted to receive the placement of a child in different configurations of use. Accordingly, the child holding accessory can be more versatile and occupy less space.

Realizations in accordance with the present invention therefore have been described only in the context of particular embodiments. These embodiments are meant to be illustrative and not limiting. Many variations, modifications, additions, and improvements are possible. Accordingly, plural instances may be provided for components described herein as a single instance. Structures and functionality presented as discrete components in the exemplary configurations may be implemented as a combined structure or component. These and other variations, modifications, additions, and improvements may fall within the scope of the invention as defined in the claims that follow.

What is claimed is:

1. A child holding accessory installable on a rigid support frame, comprising:

a reversible resting support having opposite first and second regions, and a side having a center, the first region having a first bearing surface and the second region having a second bearing surface, each of the first and second regions being positionable to be upwardly facing to receive a child on either of the first and second bearing surface, each of the first and second bearing surface being configured to provide stable support to the child placed thereon; and a fixture adapted to attach the resting support with the support frame, the fixture being rotatably connected with the resting support at a location adjacent to the center on the side of the resting support.

2. The child holding accessory according to claim 1, wherein the fixture includes a clamp adapted to removably attach with the support frame, and an adjustable coupling structure that pivotally connects the resting support with the clamp.

3. The child holding accessory according to claim 2, wherein the adjustable coupling structure is comprised of a ball and socket joint that connects the resting support with the clamp.

4. The child holding accessory according to claim 2, wherein the adjustable coupling structure comprises:

a first coupling element mounted with the resting support; and a second coupling element connected with the clamp, wherein one of the first coupling element and the second coupling element has a shaft portion defining a pivot axis of the resting support, and the second coupling element is pivotally assembled with the first coupling element about the shaft portion.

5. The child holding accessory according to claim 4, wherein the second coupling element is configured to detachably fasten with the clamp.

6. The child holding accessory according to claim 4, wherein the adjustable coupling structure further includes a latching element movably mounted between the first and second coupling elements, the latching element being operable to selectively lock the first coupling element with the second coupling element.

7. The child holding accessory according to claim 6, wherein one of the first and second coupling elements includes a circular guide track and a first locking position and a second locking position, the guide track is disposed around the pivot axis, and the first locking position and the second locking position are opposite to each other relative to a center of the guide track, the latching element being slidably engaged with the guide track when the resting support rotates about the pivot axis, and the latching element being further operable to engage with either of the first locking position or the second locking position to lock the resting support in place.

8. The child holding accessory according to claim 7, wherein the latching element engages with a first one of the two locking positions to lock the resting support in a first configuration where the first region is turned upward, and with a second one of the two locking positions to lock the resting support in a second configuration where the second region is turned upward.

9. The child holding accessory according to claim 7, wherein the adjustable coupling structure further includes a spring operable to bias the latching element in a direction substantially parallel to the pivot axis to selectively engage with the guide track and either of the first locking position and the second locking position.

10. The child holding accessory according to claim 6, wherein one of the first and second coupling elements includes a circular guide track disposed around the pivot axis, and two locking positions opposite to each other relative to a center of the guide track, and the other one of the first and second coupling elements includes two index posts that are operable to come in sliding contact with the guide track to guide rotation of the first coupling element relative to the second coupling element during adjustment of the resting support.

11. The child holding accessory according to claim 10, wherein one of the first coupling element and second coupling element has a slot, and the two index posts are located at two ends of the slot, wherein the shaft portion is inserted through the slot and the two index posts are operable to engage with the two locking positions to block rotation of the first coupling element relative to the second coupling element.

12. The child holding accessory according to claim 11, wherein the guide track is formed between an inner wall and an outer wall, and a first recessed groove and a second recessed groove are positioned at the first locking position and the second locking position respectively, wherein the first recessed groove is formed on the inner wall and the second recessed groove is formed on the outer wall.

13. The child holding accessory according to claim 10, further including a latching element operable to engage with either of the two index posts to block disengagement of the index posts from the locking positions.

14. The child holding accessory according to claim 13, wherein the latching element further includes a resilient arm integrally formed therewith and operable to urge the latching element into engagement with either of the two index posts.

15. The child holding accessory according to claim 1, wherein the resting support further includes a second side opposite to the first side having a second center, and the child holding accessory further includes a second fixture pivotally assembled with the resting support adjacent to the second center on the second side of the resting support.

16. The child holding accessory according to claim 15, wherein the second fixture includes a clamp pivotally connected with the second side of the resting support, the clamp being adapted to engage with the support frame.

17. The child holding accessory according to claim 1, wherein the first and second regions respectively include a first fabric and a second fabric to form the two bearing surfaces.

18. The child holding accessory according to claim 1, wherein the first and second regions respectively include a changing table and a child sleep bed.

19. The child holding accessory according to claim 1, wherein the resting support is in a first state when the first region faces upward, and in a second state when the second region faces upward, and the fixture remains coupled with the resting support during adjustment of the resting support from the first state to the second state and reversely from the second state to the first state.

20. A play yard comprising:

a support frame including an upper handrail;

an enclosure held with the support frame to define an inner space for accommodating a child; and the child holding accessory according to claim 1 being mounted with the upper handrail.

21. The play yard according to claim 20, wherein the child holding accessory lies substantially over a same region of the inner space when either of the first or second regions is turned upward.

22. A child holding accessory suitable for use with a play yard, comprising:

a reversible resting support having opposite first and second regions, and opposite first and second sides respectively having a first and a second center, the first region having a first bearing surface and the second region having a second bearing surface, each of the first and second regions being positionable to be upwardly facing for placement of a child on either of the first and second bearing surface, each of the first and second bearing surface being configured to provide stable support to the child placed thereon; and a supporting structure rotatably assembled with the resting support and operable to hold the resting support across the play yard, wherein the resting support is rotatable about a pivot axis relative to the supporting structure to position each of the first and second regions upwardly facing, the pivot axis being adjacent to the first and second centers of the first and second sides of the resting support, and the supporting structure includes a latching element operable to lock the resting support in place when the first or second region is positioned upwardly facing, and to unlock the resting support for rotation of the resting support relative to the supporting structure.

23. The child holding accessory according to claim 22, wherein the resting support is affixed with a first coupling element, and the supporting structure includes a second coupling element rotatably connected with the first coupling element.

24. The child holding accessory according to claim 23, wherein the latching element is assembled adjacent to the first and second coupling elements, the latching element being operable to lock the first coupling element with the second coupling element when the first or second region is positioned upwardly facing, and to unlock the first coupling element with respect to the second coupling element for rotation of the resting support relative to the supporting structure.

25. The child holding accessory according to claim 23, wherein one of the first coupling element and the second coupling element has a shaft portion that defines the pivot axis, and the second coupling element is pivotally assembled with the first coupling element about the shaft portion.

26. The child holding accessory according to claim 25, wherein one of the first and second coupling elements includes a circular guide track disposed around the pivot axis, and two locking positions opposite to each other relative to a center of the guide track, and the other one of the first and second coupling elements includes two index posts that are operable to come in sliding contact with the guide track to guide rotation of the first coupling element relative to the second coupling element during adjustment of the resting support.

27. The child holding accessory according to claim 26, wherein one of the first coupling element and second coupling element has a slot, and the two index posts are located at two ends of the slot, wherein the shaft portion is inserted through the slot and the two index posts are operable to engage with the two locking positions to block rotation of the first coupling element relative to the second coupling element.

28. The child holding accessory according to claim 27, wherein the guide track is formed between an inner wall and an outer wall, and a first recessed groove and a second recessed groove are positioned at the first locking position and the second locking position respectively, wherein the first recessed groove is formed on the inner wall and the second recessed groove is formed on the outer wall.

29. The child holding accessory according to claim 26, wherein the latching element is operable to engage with either of the two index posts to block disengagement of the index posts from the locking positions.

30. The child holding accessory according to claim 29, wherein the latching element further includes a resilient arm integrally formed therewith and operable to urge the latching element into engagement with either of the two index posts.

31. The child holding accessory according to claim 22, wherein the supporting structure is arranged adjacent to the first center of the first side of the resting support.

32. A child supporting apparatus comprising:

a rigid support frame;

a reversible resting support having opposite first and second regions, and opposite first and second sides, the first region having a first bearing surface and the second region having a second bearing surface, each of the first and second regions being positionable to be upwardly facing to receive a child on either of the first and second bearing surface, and each of the first and second bearing surface being configured to provide stable support to the child placed thereon, wherein the resting support is in a first state when the first region faces upward, and in a second state when the second region faces upward; and a first and a second fixture configured to respectively attach the first and second side of the resting support with the support frame, the first fixture being connected with the resting support via a joint that is arranged adjacent to a center of the first side, the resting support being rotatable about the joint relative to the first fixture from the first state to the second state, and reversely from the second state to the first state.

33. The child supporting apparatus according to claim 32, further including a latching element operable to lock the resting support in the first or second state.

34. The child supporting apparatus according to claim 32, wherein the first fixture includes a fastener adapted to removably attach with the support frame, and the joint pivotally connects the resting support with the fastener.

35. The child supporting apparatus according to claim 34, wherein the resting support is affixed with a first coupling element, and the fastener is connected with a second coupling element, one of the first coupling element and the second coupling element having a shaft portion defining a pivot axis of the resting support, the second coupling element being pivotally assembled with the first coupling element about the shaft portion.

36. The child supporting apparatus according to claim 35, wherein one of the first and second coupling element includes a circular guide track disposed around the pivot axis, and two locking positions opposite to each other relative to a center of the guide track, and the other one of the first and second coupling elements includes an index post that is operable to come in sliding contact with the guide track to guide rotation of the first coupling element relative to the second coupling element during adjustment of the resting support, the index post being operable to engage with any of the locking positions to block rotation of the first coupling element relative to the second coupling element.

37. The child supporting apparatus according to claim 36, further including a latching element operable to engage with the index post to block disengagement of the index post from any of the locking positions.

38. The child supporting apparatus according to claim 32, wherein the second side of the resting support has a second center, and the second fixture is connected with the resting support adjacent to the second center of the second side.

39. The child supporting apparatus according to claim 38, wherein the resting support is rotatable about a pivot axis extending adjacent to the first and second centers.

* * * * *